US007173596B2

(12) United States Patent
Toriumi et al.

(10) Patent No.: US 7,173,596 B2
(45) Date of Patent: Feb. 6, 2007

(54) DISPLAY DRIVER AND ELECTRO-OPTICAL DEVICE

(75) Inventors: Yuichi Toriumi, Chino (JP); Akira Morita, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 515 days.

(21) Appl. No.: 10/792,819

(22) Filed: Mar. 5, 2004

(65) Prior Publication Data

US 2004/0233227 A1 Nov. 25, 2004

(30) Foreign Application Priority Data

Mar. 11, 2003 (JP) ..... 2003-065380

(51) Int. Cl.
*G09G 3/36* (2006.01)

(52) U.S. Cl. ..... 345/98; 345/89; 345/103; 345/690

(58) Field of Classification Search ..... 345/89, 345/92, 98–100, 103, 204, 690; 348/793
See application file for complete search history.

(56) References Cited

U.S. PATENT DOCUMENTS 6,839,046 B1 * 1/2005 Orisaka et al. ..... 345/98
6,909,417 B2 * 6/2005 Washio et al. ..... 345/98
6,909,418 B2 * 6/2005 Arai ..... 345/98
6,919,875 B2 * 7/2005 Abe et al. ..... 345/100
6,980,187 B2 * 12/2005 Toriumi ..... 345/89
7,030,869 B2 * 4/2006 Morita ..... 345/208
2002/0149557 A1 * 10/2002 Goetz et al. ..... 345/100

FOREIGN PATENT DOCUMENTS

| | | |
|---|---|---|
| JP | A-02-146085 | 6/1990 |
| JP | A-09-050264 | 2/1997 |
| JP | A-2001-051656 | 2/2001 |
| JP | A 2002-156654 | 5/2002 |
| JP | A-2004-233770 | 8/2004 |
| JP | A-2004-233772 | 8/2004 |

OTHER PUBLICATIONS

U.S. Appl. No. 10/754,554, filed Jan. 12, 2004, Toriumi et al.
U.S. Appl. No. 10/834,036, filed Apr. 29, 2004, Morita et al.
U.S. Appl. No. 10/833,996, filed Apr. 29, 2004, Morita et al.
U.S. Appl. No. 10/790,059, filed Mar. 2, 2004, Toriumi et al.
U.S. Appl. No. 10/790,692, filed Mar. 3, 2004, Toriumi et al.
U.S. Appl. No. 10/790,869, filed Mar. 3, 2004, Toriumi et al.
U.S. Appl. No. 10/790,806, filed Mar. 3, 2004, Toriumi et al.

* cited by examiner

*Primary Examiner*—Henry N. Tran
(74) *Attorney, Agent, or Firm*—Oliff & Berridge, PLC

(57) ABSTRACT

A comb-tooth drive is realized by a display driver which drives data lines. The display driver includes a gray-scale bus to which gray-scale data is supplied corresponding to an arrangement order of the data lines, first and second bidirectional shift registers of which the shift directions are determined based on first and second shift direction control signals and which shift first and second shift start signals based on first and second shift clock signals, first and second data latches which latch the gray-scale data based on shift outputs, and a data line driver circuit which drives the data lines based on the latch data.

21 Claims, 19 Drawing Sheets

DISPLAY DRIVER AND ELECTRO-OPTICAL DEVICE

Japanese Patent Application No. 2003-65380, filed on Mar. 11, 2003, is hereby incorporated by reference in its entirety.

BACKGROUND OF THE INVENTION

The present invention relates to a display driver and an electro-optical device.

A display panel (display device in a broad sense) represented by a liquid crystal display (LCD) panel is mounted on portable telephones and personal digital assistants (PDAs). In particular, an LCD panel realizes a reduction of size, power consumption, and cost in comparison with other display panels, and is mounted on various electronic instruments.

An LCD panel is required to have a size equal to or greater than a certain size taking visibility of an image to be displayed into consideration. On the other hand, there has been a demand that the mounting size of the LCD panel be as small as possible when the LCD panel is mounted on electronic instruments.

BRIEF SUMMARY OF THE INVENTION

According to one aspect of the present invention, there is provided a display driver which drives a plurality of data lines of an electro-optical device, the electro-optical device including: a plurality of scan lines; the data lines which are alternately arranged inwardly from opposite sides of the electro-optical device to have a shape of comb-teeth; a plurality of switching elements, each of the switching elements being connected with one of the scan lines and one of the data lines; and a plurality of pixel electrodes, each of the pixel electrodes being connected with one of the switching elements, the display driver comprising:

a gray-scale bus to which gray-scale data is supplied corresponding to an arrangement order of the data lines;

a first bidirectional shift register which shifts a first shift start signal in a first shift direction specified by a first shift direction control signal, based on a first shift clock signal;

a second bidirectional shift register which shifts a second shift start signal in a second shift direction specified by a second shift direction control signal, based on a second shift clock signal;

a first data latch which includes a plurality of flip-flops, each of which holds the gray-scale data corresponding to one of the data lines, based on a shift output in each stage of the first bidirectional shift register;

a second data latch which includes a plurality of flip-flops, each of which holds the gray-scale data corresponding to one of the data lines, based on a shift output in each stage of the second bidirectional shift register; and a data line driver circuit in which a plurality of data output sections are disposed corresponding to the arrangement order of the data lines, each of the data output sections driving one of the data lines based on the gray-scale data held in the flip-flops of the first data latch or the flip-flops of the second data latch.

DETAILED DESCRIPTION OF THE EMBODIMENT

Embodiments of the present invention are described below. Note that the embodiments described hereunder do not in any way limit the scope of the invention defined by the claims laid out herein. Note also that all of the elements described below should not be taken as essential requirements for the present invention.

As an LCD panel which can reduce the mounting size as described above, a so-called comb-tooth distributed LCD panel has been known.

In order to reduce the mounting size of the LCD panel, it is effective to reduce the interconnect region between the LCD panel and a scan driver which drives scan lines of the LCD panel, or to reduce the interconnect region between the LCD panel and a display driver which drives data lines of the LCD panel.

In the case where a display driver drives data lines of a comb-tooth distributed LCD panel from opposite sides of the LCD panel, it is necessary to change the order of gray-scale data which is supplied corresponding to the arrangement order of the data lines in a conventional LCD panel.

Since a conventional display driver cannot change the order of gray-scale data supplied corresponding to the data lines, a dedicated data scramble IC must be added when driving the comb-tooth distributed LCD panel using a conventional display driver.

In the comb-tooth distributed LCD panel in which the order of gray-scale data must be changed as described above, the method of changing the order differs depending on the orientation of an image to be displayed on the LCD panel.

According to the following embodiments, a display driver and an electro-optical device capable of driving a display panel having comb-tooth distributed data lines corresponding to the orientation of the image to be displayed can be provided.

The embodiments of the present invention are described below in detail with reference to the drawings.

1. Electro-Optical Device

Figure 1:
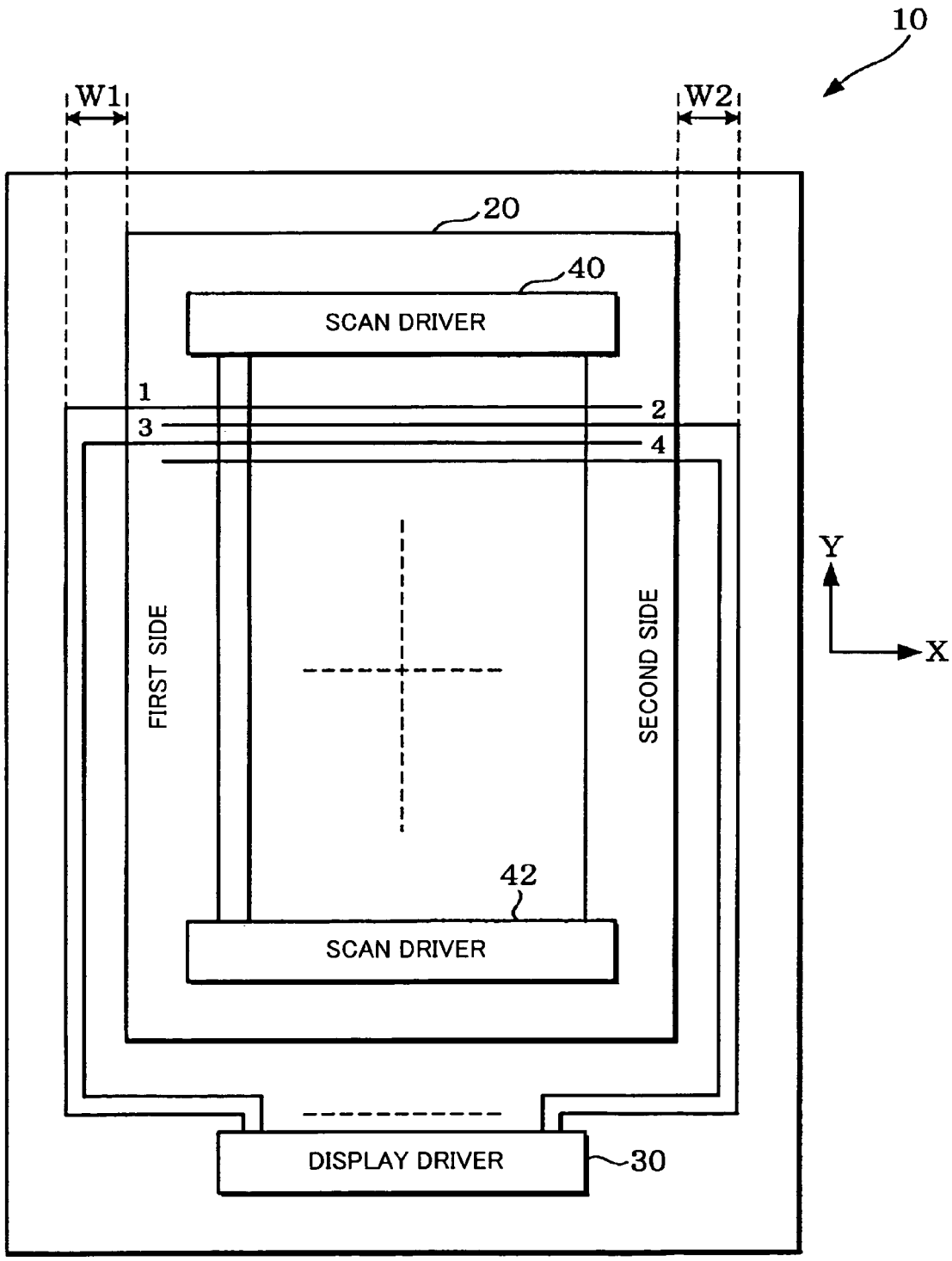
FIG. 1 is a block diagram of an outline of a configuration of an electro-optical device in an embodiment of the present invention.

FIG. 1 shows an outline of a configuration of an electro-optical device in an embodiment of the present invention. FIG. 1 shows a liquid crystal device as an example of an electro-optical device. A liquid crystal device may be incorporated in various electronic instruments such as a portable telephone, portable information instrument (PDA or the like), digital camera, projector, portable audio player, mass storage device, video camera, electronic notebook, or global positioning system (GPS).

A liquid crystal device 10 includes an LCD panel 20 (display panel in a broad sense; electro-optical device in a broader sense), a display driver 30 (source driver), and scan drivers 40 and 42 (gate drivers).

The liquid crystal device 10 does not necessarily include all of these circuit blocks. The liquid crystal device 10 may have a configuration in which some of these circuit blocks are omitted.

The LCD panel 20 includes a plurality of scan lines (gate lines), a plurality of data lines (source lines) which intersect the scan lines, and a plurality of pixels, each of the pixels being specified by one of the scan lines and one of the data lines. In the case where one pixel consists of three color components of RGB, one pixel consists of three dots, one dot each for red, green, and blue. The dot may be referred to as an element point which makes up each pixel. The data lines corresponding to one pixel may be referred to as data lines for the number of color components which make up one pixel. The following description is appropriately given on the assumption that one pixel consists of one dot for convenience of description.

Each of the pixels includes a thin film transistor (hereinafter abbreviated as "TFT") (switching element) and a pixel electrode. The TFT is connected with the data line, and the pixel electrode is connected with the TFT.

The LCD panel 20 is formed on a panel substrate such as a glass substrate. A plurality of scan lines, arranged in the X direction shown in FIG. 1 and extending in the Y direction, and a plurality of data lines, arranged in the Y direction and extending in the X direction, are disposed on the panel substrate. In the LCD panel 20, the data lines are comb-tooth distributed. In FIG. 1, the data lines are comb-tooth distributed so as to be driven from a first side of the LCD panel 20 and a second side which faces the first side. The comb-tooth distribution may be referred to as a distribution in which a given number of data lines (one or a plurality of data lines) are alternately arranged from opposite sides (first and second sides of the LCD panel 20) toward the inside of the LCD panel 20 to have a shape of comb-teeth.

Figure 2:
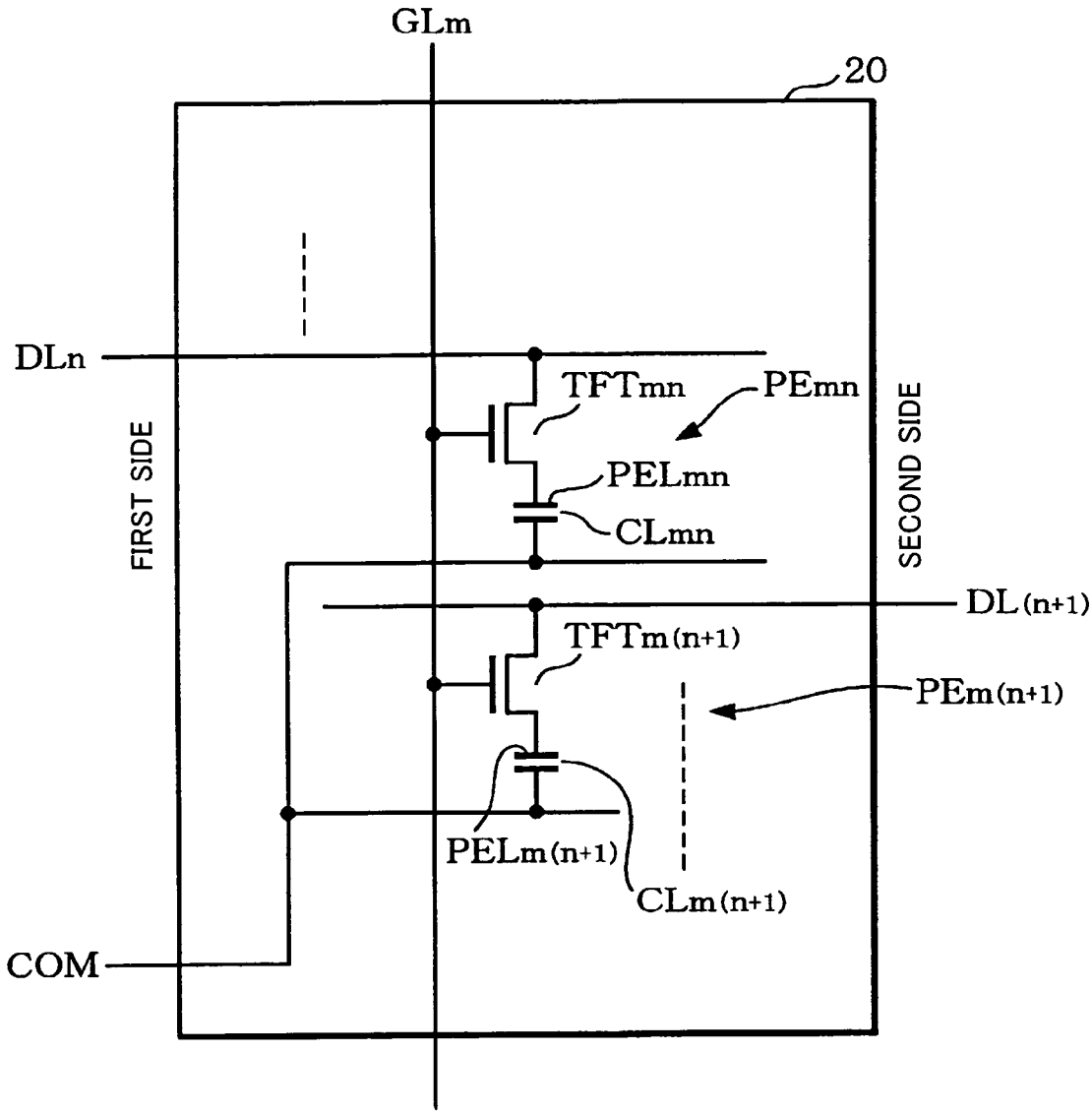
FIG. 2 is a schematic diagram of a configuration of a pixel in an embodiment of the present invention.

FIG. 2 schematically shows a configuration of the pixel. In FIG. 2, one pixel consists of one dot. A pixel PEmn is disposed at a position corresponding to the intersecting point of the scan line GLm ($1 \leqq m \leqq M$, M and m are integers) and the data line DLn ($1 \leqq n \leqq N$, N and n are integers). The pixel PEmn includes the TFTmn and the pixel electrode PELmn.

A gate electrode of the TFTmn is connected with the scan line GLm. A source electrode of the TFTmn is connected with the data line DLn. A drain electrode of the TFTmn is connected with the pixel electrode PELmn. A liquid crystal capacitor CLmn is formed between the pixel electrode and a common electrode COM which faces the pixel electrode through a liquid crystal element (electro-optical material in a broad sense). A storage capacitor may be formed in parallel with the liquid crystal capacitor CLmn. Transmissivity of the pixel changes corresponding to the voltage applied between the pixel electrode and the common electrode COM. A voltage VCOM supplied to the common electrode COM is generated by a power supply circuit (not shown).

The LCD panel 20 is formed by attaching a first substrate on which the pixel electrode and the TFT are formed to a second substrate on which the common electrode is formed, and sealing a liquid crystal as an electro-optical material between the two substrates.

The scan line is scanned by the scan drivers 40 and 42. In FIG. 1, one scan line is driven by the scan drivers 40 and 42 at the same time.

The data line is driven by the display driver 30. The data line is driven by the display driver 30 from the first side of the LCD panel 20 or the second side of the LCD panel 20 which faces the first side. The first and second sides of the LCD panel 20 face in the direction in which the data lines extend.

In the comb-tooth distributed LCD panel 20, the data lines are provided corresponding to the pixels and driven inwardly from opposite sides, each of the pixels is connected to corresponding one of the scanning lines, and the number of the data lines for one pixel is equal to the number of color components of each pixel.

More specifically, in FIG. 2, in the LCD panel 20 in which the data lines are comb-tooth distributed, in the case where the data lines DLn and DL(n+1) are disposed corresponding to the adjacent pixels connected with the selected scan line GLm, the data line DLn is driven by the display driver 30 from the first side of the LCD panel 20, and the data line DL(n+1) is driven by the display driver 30 from the second side of the LCD panel 20.

The above description also applies to the case where the data lines corresponding to the RGB color components are disposed corresponding to one pixel. In this case, if the data line DLn consisting of a set of three color component data lines (Rn, Gn, Bn) and the data line DL(n+1) consisting of a set of three color component data lines (R(n+1), G(n+1), B(n+1)) are disposed corresponding to the adjacent pixels connected with the selected scan line GLm, the data line DLn is driven by the display driver 30 from the first side of the LCD panel 20, and the data line DL(n+1) is driven by the display driver 30 from the second side of the LCD panel 20.

The display driver 30 drives the data lines DL1 to DLN of the LCD panel 20 based on gray-scale data for one horizontal scanning period supplied in units of horizontal scanning periods. In more detail, the display driver 30 is capable of driving at least one of the data lines DL1 to DLN based on the gray-scale data.

The scan drivers 40 and 42 scan the scan lines GL1 to GLM of the LCD panel 20. In more detail, the scan drivers 40 and 42 consecutively select the scan lines GL1 to GLM within one vertical scanning period, and drive the selected scan line.

The display driver 30 and the scan drivers 40 and 42 are controlled by using a controller (not shown). The controller outputs control signals to the display driver 30, the scan drivers 40 and 42, and the power supply circuit according to the contents set by a host such as a central processing unit (CPU). In more detail, the controller supplies an operation mode setting and a horizontal synchronization signal or a vertical synchronization signal generated therein to the display driver 30 and the scan drivers 40 and 42, for example. The horizontal synchronization signal specifies the horizontal scanning period. The vertical synchronization signal specifies the vertical scanning period. The controller controls the power supply circuit relating to polarity reversal timing of the voltage VCOM applied to the common electrode COM.

The power supply circuit generates various voltages applied to the LCD panel 20 and the voltage VCOM applied to the common electrode COM based on a reference voltage supplied from the outside.

In FIG. 1, the liquid crystal device 10 may include the controller, or the controller may be provided outside the liquid crystal device 10. The host (not shown) may be included in the liquid crystal device 10 together with the controller.

At least one of the scan drivers 40 and 42, the controller, and the power supply circuit may be included in the display driver 30.

Some or all of the display driver 30, the scan drivers 40 and 42, the controller, and the power supply circuit may be formed on the LCD panel 20. For example, the display driver 30 and the scan drivers 40 and 42 may be formed on the LCD panel 20. In this case, the LCD panel 20 may be called an electro-optical device. The LCD panel 20 may be formed to include the data lines, the scan lines, the pixels, each of which is specified by one of the data lines and one of the scan lines, the display driver which drives the data lines, and the scan drivers which scan the scan lines. The pixels are formed in a pixel formation region of the LCD panel 20.

The advantages of the comb-tooth distributed LCD panel are described below.

Figure 3:
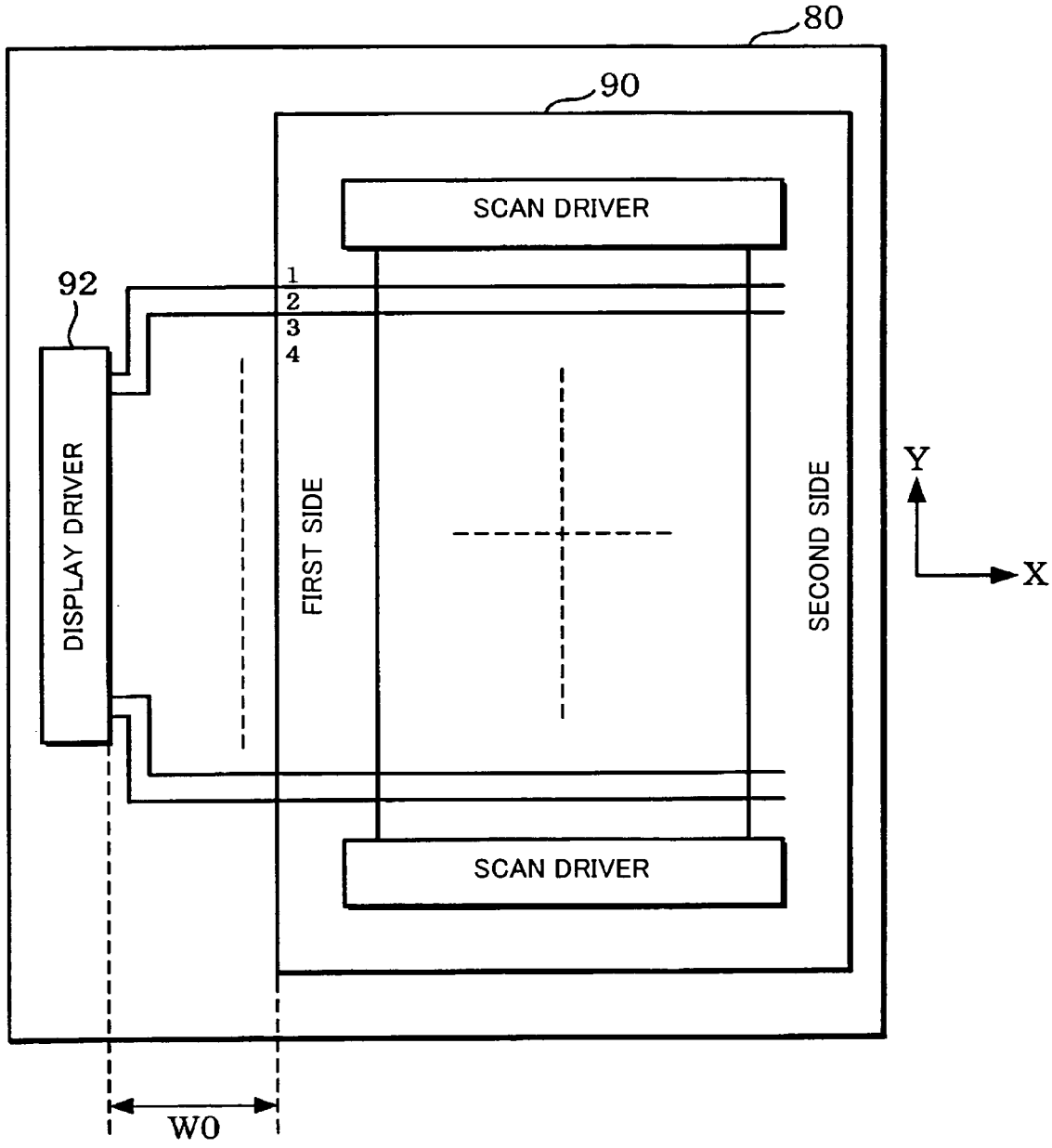
FIG. 3 is a block diagram schematically showing a configuration of an electro-optical device including an LCD panel which is not comb-tooth distributed.

FIG. 3 schematically shows a configuration of an electro-optical device including an LCD panel which is not comb-tooth distributed. An electro-optical device 80 shown in FIG. 3 includes an LCD panel 90 which is not comb-tooth distributed. In the LCD panel 90, the data lines are driven by a display driver 92 from the first side. Therefore, an interconnect region for connecting the data output sections of the display driver 92 with the data lines of the LCD panel 90 is necessary. If the number of data lines is increased and the lengths of the first and second sides of the LCD panel 90 are increased, it is necessary to bend each interconnect, whereby a width W0 is necessary for the interconnect region.

On the contrary, in the electro-optical device 10 shown in FIG. 1, only widths W1 and W2 which are smaller than the width W0 are respectively necessary on the first and second sides of the LCD panel 20.

Taking mounting on electronic instruments into consideration, it is disadvantageous that the length of the LCD panel (electro-optical device) is increased in the direction of the short side in comparison with the case where the length of the LCD panel is increased in the direction of the long side to some extent. This is undesirable from the viewpoint of the design, since the width of the frame of the display section of the electronic instrument is increased, for example.

In FIG. 3, the length of the LCD panel is increased in the direction of the short side. In FIG. 1, the length of the LCD panel is increased in the direction of the long side. Therefore, the widths of the interconnect regions on the first and second sides can be made narrow to almost an equal extent. In FIG. 1, the area of the non-interconnect region in FIG. 3 can be reduced, whereby the mounting size can be reduced.

Figure 4:
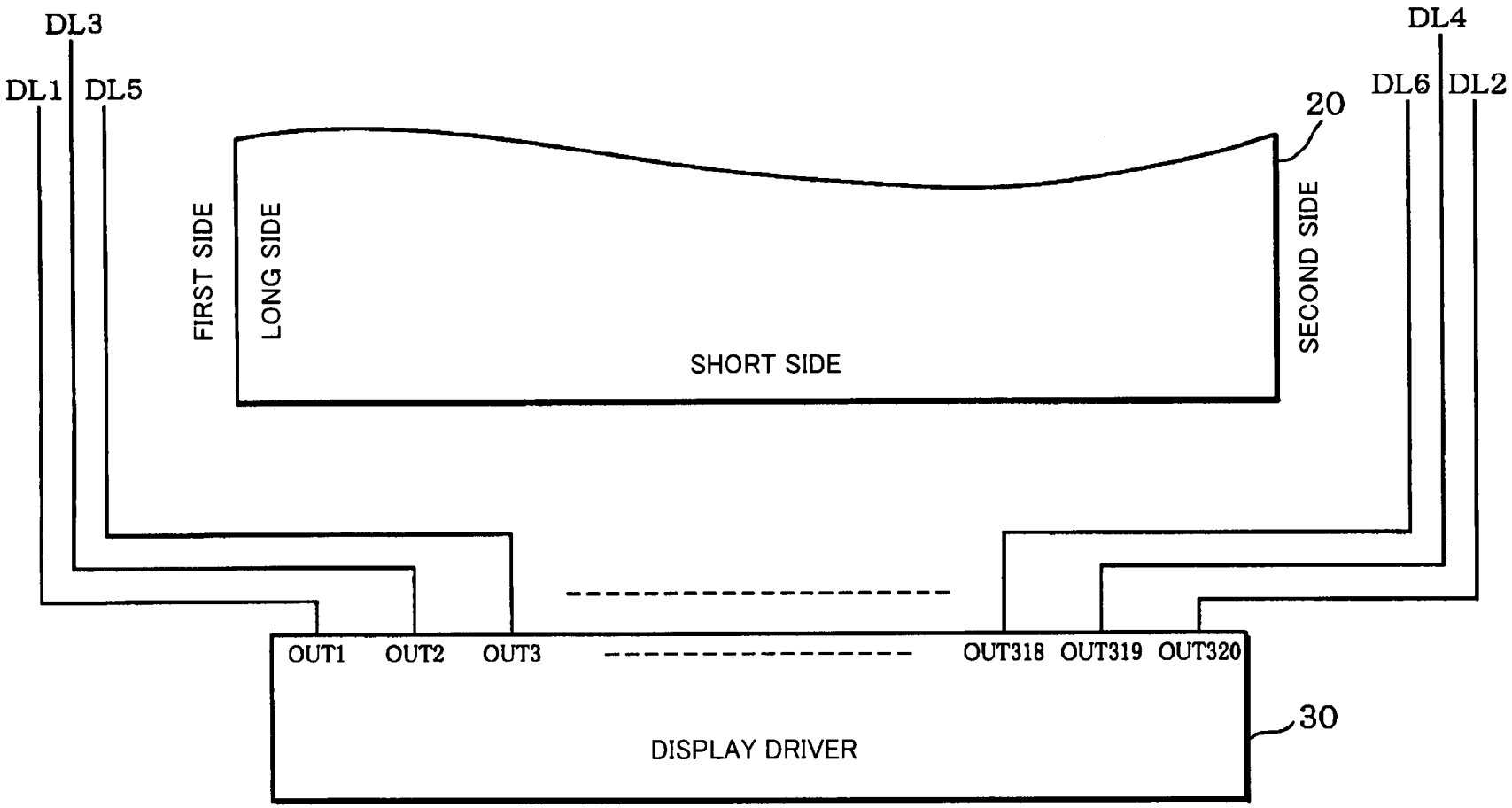
FIG. 4 is an explanatory diagram showing an example of a display driver disposed along the short side of an LCD panel.

In the case where the arrangement order of the data output sections of the display driver 30 corresponds to the arrangement order of the data lines of the LCD panel 20, interconnects which connect the data output sections with the data lines can be disposed from the first and second sides by disposing the display driver 30 along the short side of the LCD panel 20 as shown in FIG. 4, whereby the interconnects can be simplified and the area of the interconnect region can be reduced.

However, in the display driver 30 which receives the gray-scale data output corresponding to the arrangement order of the data lines by using a general-purpose controller, it is necessary to change the order of the received gray-scale data when driving the LCD panel 20.

The following description is given on the assumption that the display driver 30 includes data output sections OUT1 to OUT320, and the data output sections are arranged in the direction from the first side to the second side. The data output sections correspond to the data lines of the LCD panel 20.

Figure 5:
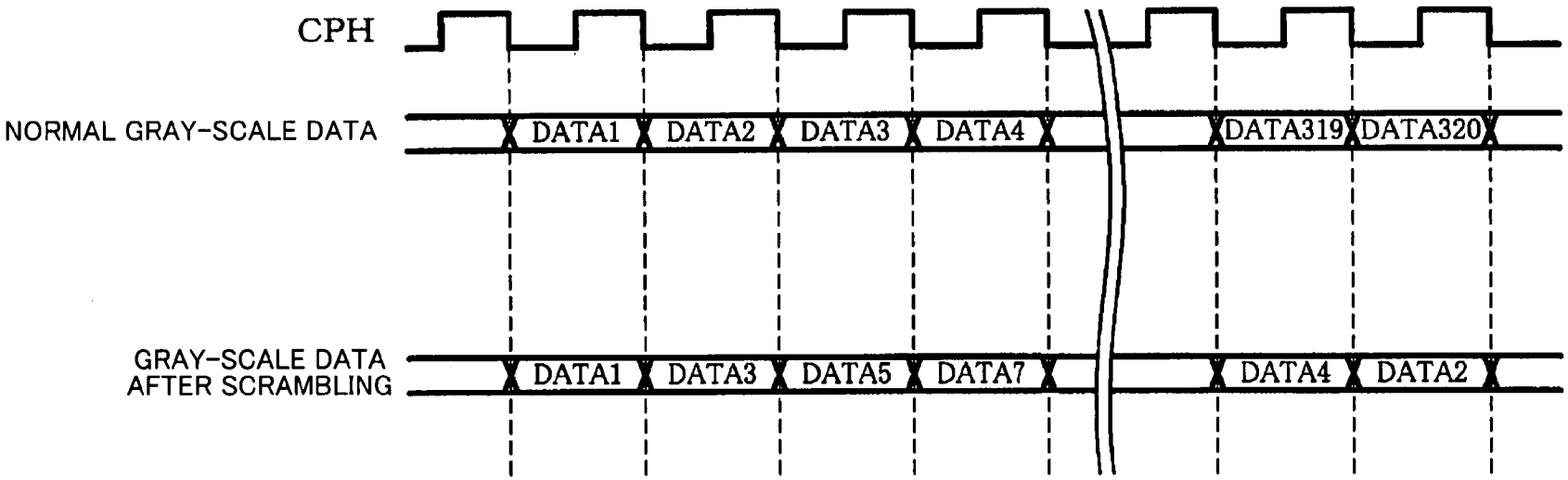
FIG. 5 is illustrative of necessity of data scrambling for driving a comb-tooth distributed LCD panel.

A general-purpose controller supplies gray-scale data DATA1 to DATA320 respectively corresponding to the data lines DL1 to DL320 to the display driver 30 in synchronization with a reference clock signal CPH, as shown in FIG. 5. In the case where the display driver 30 drives the LCD panel which is not comb-tooth distributed as shown in FIG. 3, since the data output section OUT1 is connected with the data line DL1, the data output section OUT2 is connected with the data line DL2, . . . , and the data output section OUT320 is connected with the data line DL320, an image can be displayed without causing a problem. However, in the case where the display driver 30 drives the comb-tooth distributed LCD panel as shown in FIG. 1 or 4, since the data output section OUT1 is connected with the data line DL1, the data output section OUT2 is connected with the data line DL3, . . . , and the data output section OUT320 is connected with the data line DL2, a desired image cannot be displayed.

Therefore, it is necessary to change the arrangement of the gray-scale data as shown in FIG. 5 by performing scramble processing which changes the order of the gray-scale data. Therefore, in the case of driving the comb-tooth distributed LCD panel by using a display driver controlled by using a general-purpose controller, a dedicated data scramble IC which performs the above scramble processing is added, whereby the mounting size is inevitably increased.

The display driver 30 in the present embodiment is capable of driving the comb-tooth distributed LCD panel based on the gray-scale data supplied from a general-purpose controller by using the configuration described below.

In the case of driving the data lines of the comb-tooth distributed LCD panel 20 by using the display driver 30, the arrangement order of the gray-scale data must be changed corresponding to the orientation of the image to be displayed.

Figure 6A:
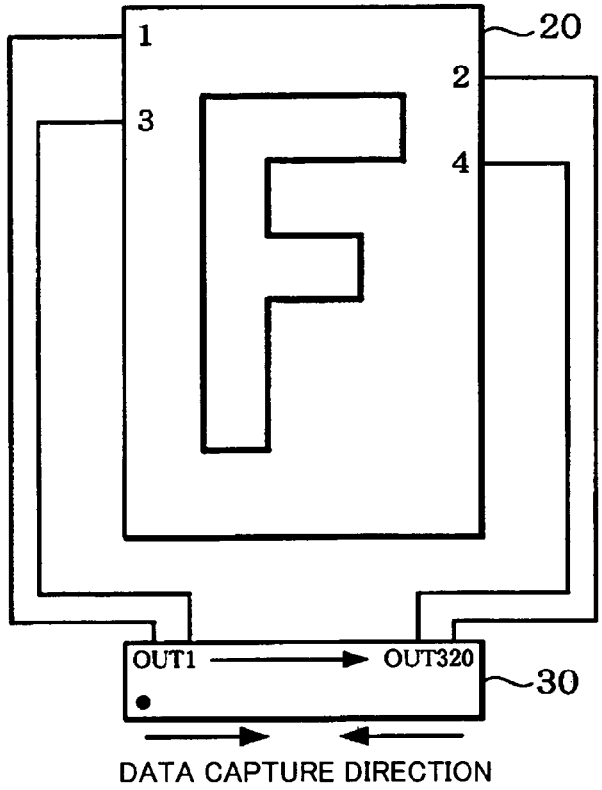
FIG. 6A is a schematic diagram showing a first mounting state of a display driver relative to an LCD panel.
Figure 6B:
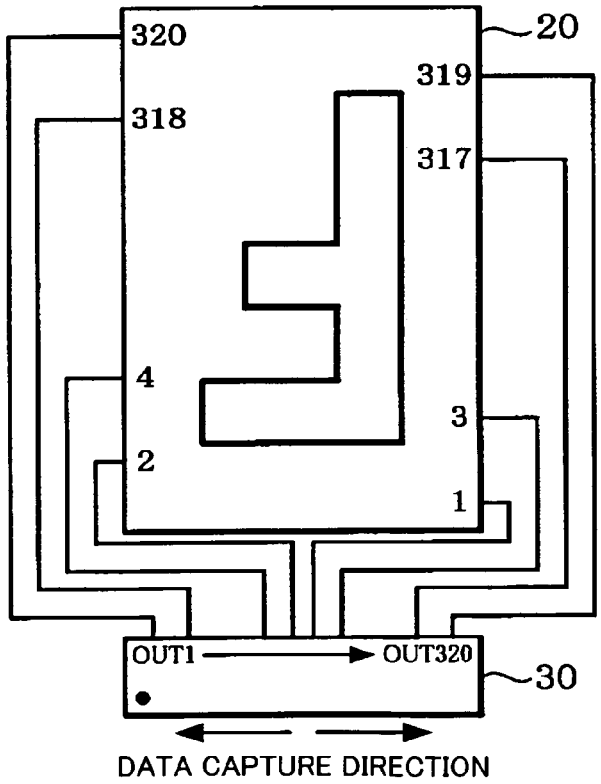
FIG. 6B is a schematic diagram showing a second mounting state of a display driver relative to an LCD panel.

FIG. 6A schematically shows a first mounting state of the display driver 30 relative to the LCD panel 20. FIG. 6B schematically shows a second mounting state of the display driver 30 relative to the LCD panel 20.

In this example, the display driver 30 is capable of changing the arrangement order of the gray-scale data in order to display the image shown in FIG. 6A. Therefore, the display driver 30 captures the gray-scale data DATA1, DATA2, DATA3, and so on in the order of the data output section OUT1, the data output section OUT 320, and the data output section OUT 3, and so on, as shown in FIG. 5 (first mounting state).

However, in the case where the display driver 30 captures the gray-scale data in the same order in the second mounting state, since the drive voltage based on the gray-scale data DATA1 is output from the data output section OUT1, the image shown in FIG. 6B cannot be displayed.

As described above, the arrangement order of the gray-scale data and the capture direction of the gray-scale data must be changed corresponding to the orientation of the image to be displayed in the LCD panel 20, even if the display driver 30 is in the same mounting state relative to the LCD panel 20.

2. Display Driver

Figure 7:
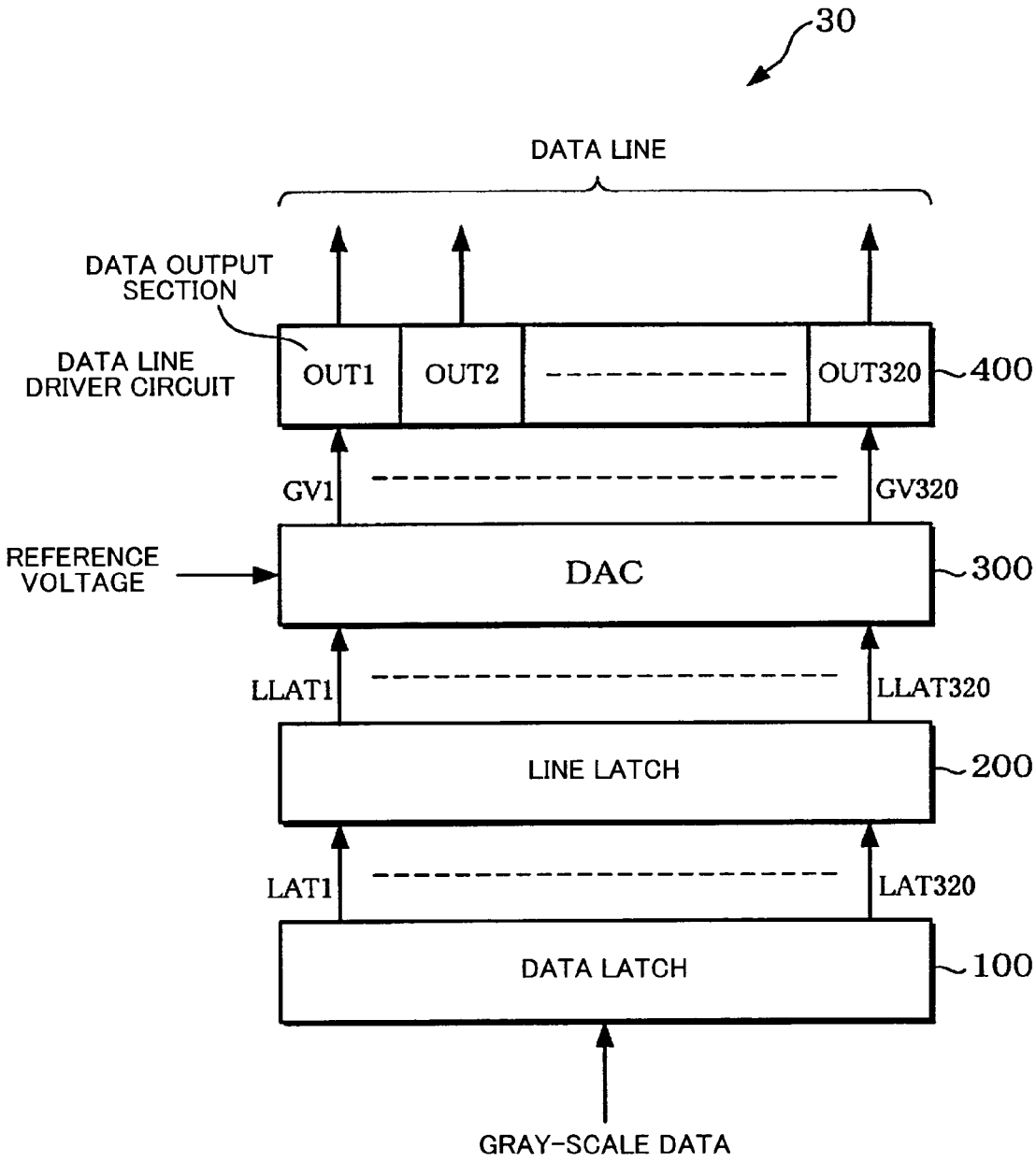
FIG. 7 is a block diagram of an outline of a configuration of a display driver in an embodiment of the present invention.

FIG. 7 shows an outline of a configuration of the display driver 30. The display driver 30 includes a data latch 100, a line latch 200, a digital-to-analog converter (DAC) 300 (voltage select circuit in a broad sense), and a data line driver circuit 400.

The data latch 100 captures the gray-scale data in one horizontal scanning cycle.

The line latch 200 latches the gray-scale data captured by the data latch 100 based on a horizontal synchronization signal Hsync.

The DAC 300 selectively outputs the drive voltage (gray-scale voltage) corresponding to the gray-scale data output from the line latch 200 in units of data lines from a plurality of reference voltages corresponding to the gray-scale data. In more detail, the DAC 300 decodes the gray-scale data from the line latch 200, and selects one of the reference voltages based on the decoded result. The reference voltage selected by the DAC 300 is output to the data line driver circuit 400 as the drive voltage.

The data line driver circuit 400 includes 320 data output sections OUT1 to OUT320. The data line driver circuit 400 drives the data lines DL to DLN based on the drive voltage from the DAC 300 through the data output sections OUT1 to OUT320. In the data line driver circuit 400, the data output sections (OUT1 to OUT320), each of which drives the data line based on the gray-scale data (latch data) held in the line latch 200 (flip-flop of the first or second data latch), are disposed corresponding to the arrangement order of the data lines. The above description illustrates the case where the data line driver circuit 400 includes 320 data output sections OUT1 to OUT320. However, the number of data output sections is not limited thereto.

In the display driver 30, the latch data LAT1 captured by the data latch 100 is output to the line latch 200. The latch data LLAT1 latched by the line latch 200 is output to the DAC 300. The DAC 300 generates a drive voltage GV1 corresponding to the latch data LLAT1 output from the line latch 200. The data output section OUT1 of the data line driver circuit 400 drives the data line connected with the data output section OUT1 based on the drive voltage GV1 output from the DAC 300.

As described above, the display driver 30 captures the gray-scale data in the data latch 100 in units of data output sections of the data line driver circuit 400. The latch data latched by the data latch 100 in units of data output sections may be in units of one pixel, in units of a plurality of pixels, in units of one dot, or in units of a plurality of dots.

Figure 8:
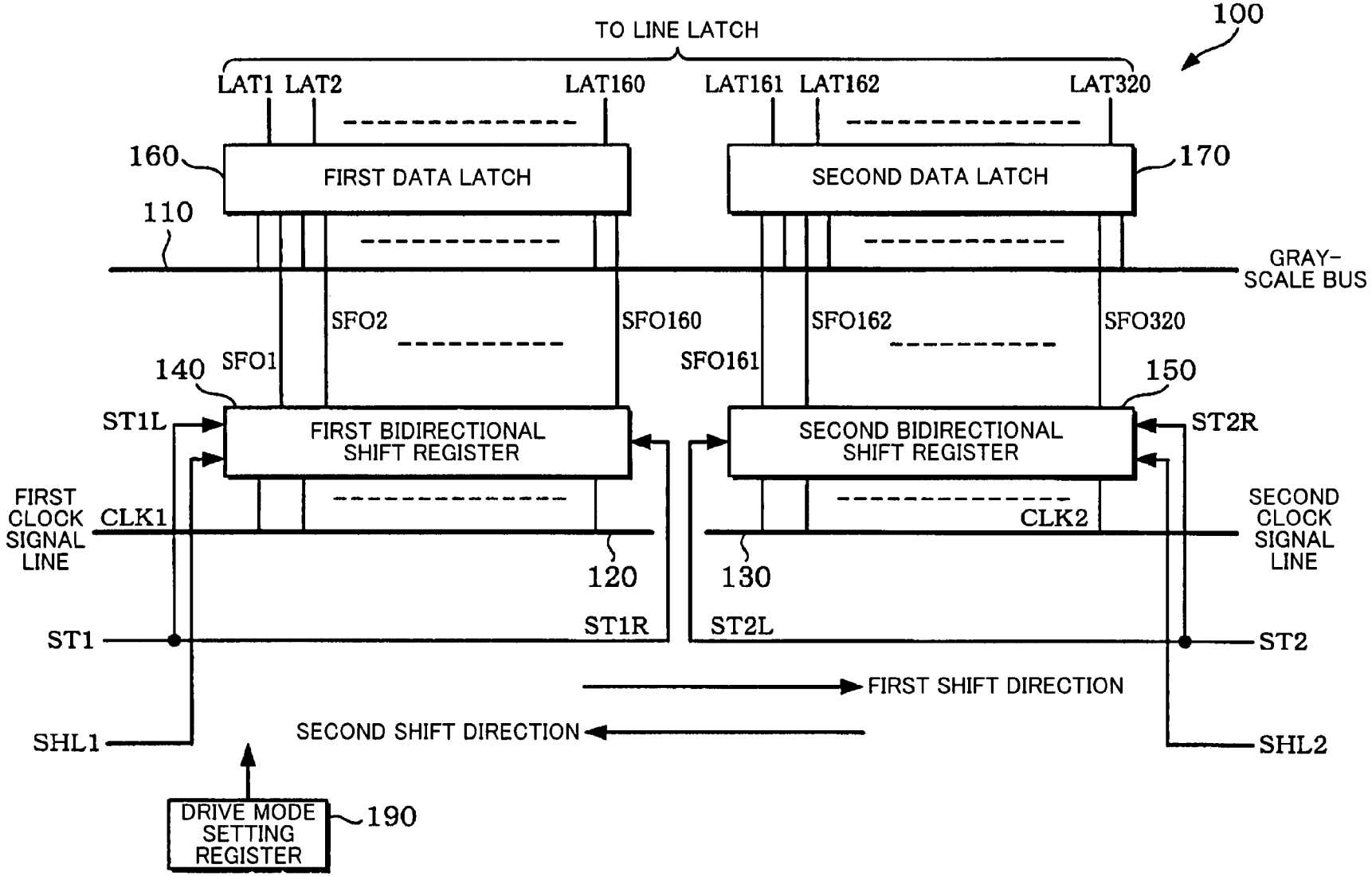
FIG. 8 is a block diagram showing an outline of a configuration of a data latch shown in FIG. 7.

FIG. 8 shows an outline of the configuration of the data latch 100 shown in FIG. 7. The data latch 100 includes a gray-scale bus 110, first and second clock signal lines 120 and 130, first and second bidirectional shift registers 140 and 150, and first and second data latches 160 and 170.

The gray-scale data is supplied to the gray-scale bus 110 corresponding to the arrangement order of the data lines DL1 to DLN. A first shift clock signal CLK1 is supplied to the first clock signal line 120. A second shift clock signal CLK2 is supplied to the second clock signal line 130.

The first bidirectional shift register 140 shifts first shift start signals ST1L and ST1R in a first shift direction or a second shift direction opposite to the first shift direction based on the first shift clock signal CLK1. The first shift direction may be the direction from the first side to the second side of the LCD panel 20. The first bidirectional register 140 changes the shift direction to either the first or second shift direction based on a first shift direction control signal SHL1. Specifically, the shift direction of the first bidirectional shift register 140 is determined by the first shift direction control signal SHL1. Shift outputs SFO1 to SFO160 from the first bidirectional shift register 140 are output to the first data latch 160.

Figure 9:
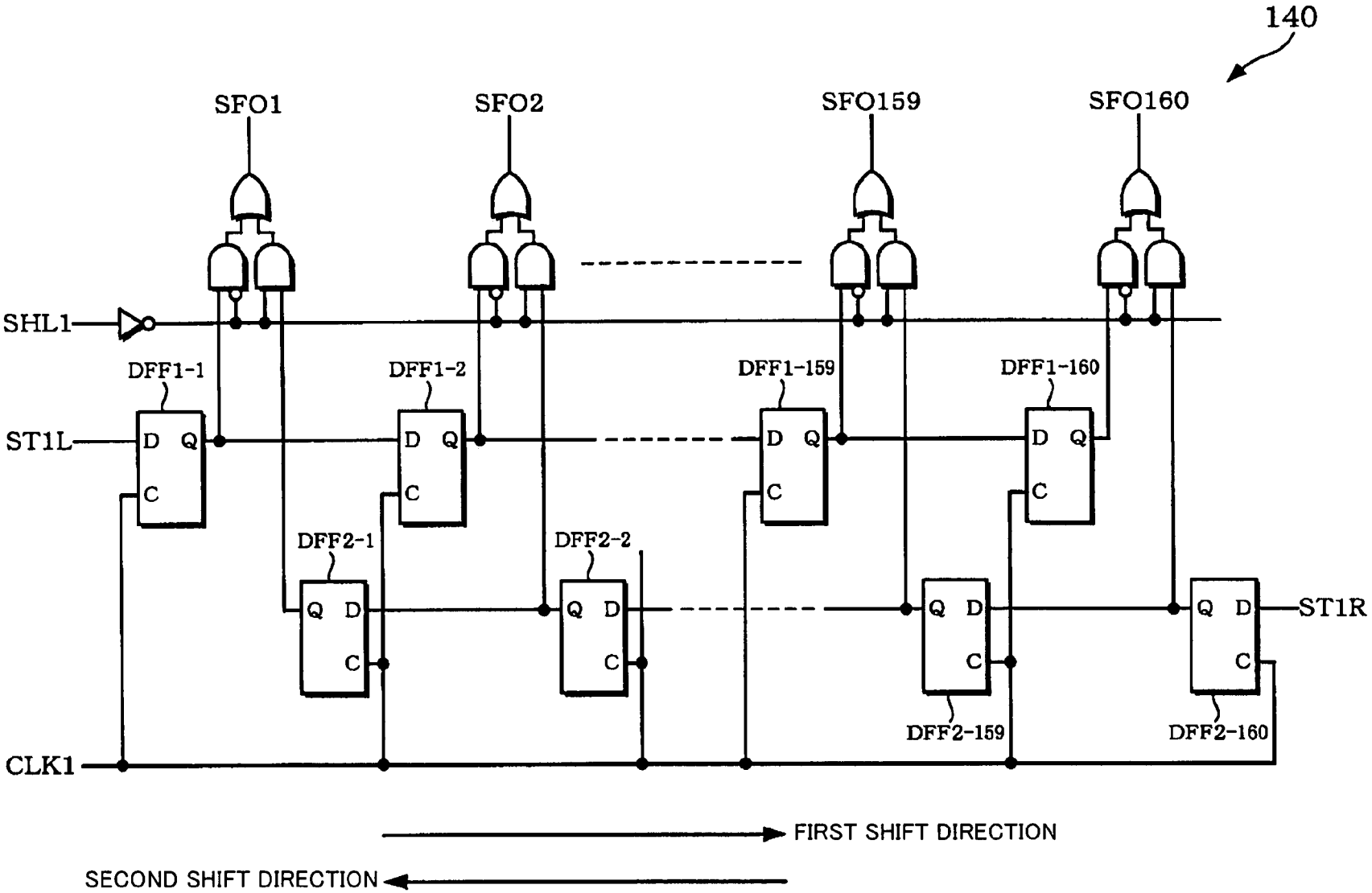
FIG. 9 is a circuit diagram showing a configuration example of a first bidirectional shift register.

FIG. 9 shows a configuration example of the first bidirectional shift register 140. In the first bidirectional shift register 140, D flip-flops DFF1-1 to DFF1-160 are connected in series so that a pulse of the first shift start signal ST1L is shifted in the first shift direction. A Q terminal of the D flip-flop DFF1-k ($1 \leqq k \leqq 159$, k is a natural number) is connected with a D terminal of the D flip-flop DFF1-(k+1) in the subsequent stage. In the first bidirectional shift register 140, D flip-flops DFF2-160 to DFF2-1 are connected in series so that a pulse of the second shift start signal ST1R is shifted in the second shift direction. A Q terminal of the D flip-flop DFF2-k ($2 \leqq k \leqq 160$, k is a natural number) is connected with a D terminal of the D flip-flop DFF2-(k−1) in the subsequent stage.

Either the shift output from the Q terminal of the D flip-flop DFF1-i ($1 \leqq i \leqq 160$, 1 is a natural number) or the shift output from the Q terminal of the D flip-flop DFF2-i is selected by the first shift direction control signal SHL1 and output as the shift output SFOi.

The first shift start signal ST1L for outputting the shift output in the first shift direction is input to the D terminal of the D flip-flop DFF1-1. The first shift start signal ST1L for outputting the shift output in the second shift direction is input to the D terminal of the D flip-flop DFF2-160.

In FIG. 8, the second bidirectional shift register 150 shifts second shift start signals ST2L and ST2R in the first shift direction or the second shift direction opposite to the first shift direction based on the second shift clock signal CLK2. The second bidirectional shift register 150 changes the shift direction to either the first or second shift direction based on a second shift direction control signal SHL2. Specifically, the shift direction of the second bidirectional register 150 is determined by the second shift direction control signal SHL2. Shift outputs SFO161 to SFO320 from the second bidirectional shift register 150 are output to the second data latch 170.

Figure 10:
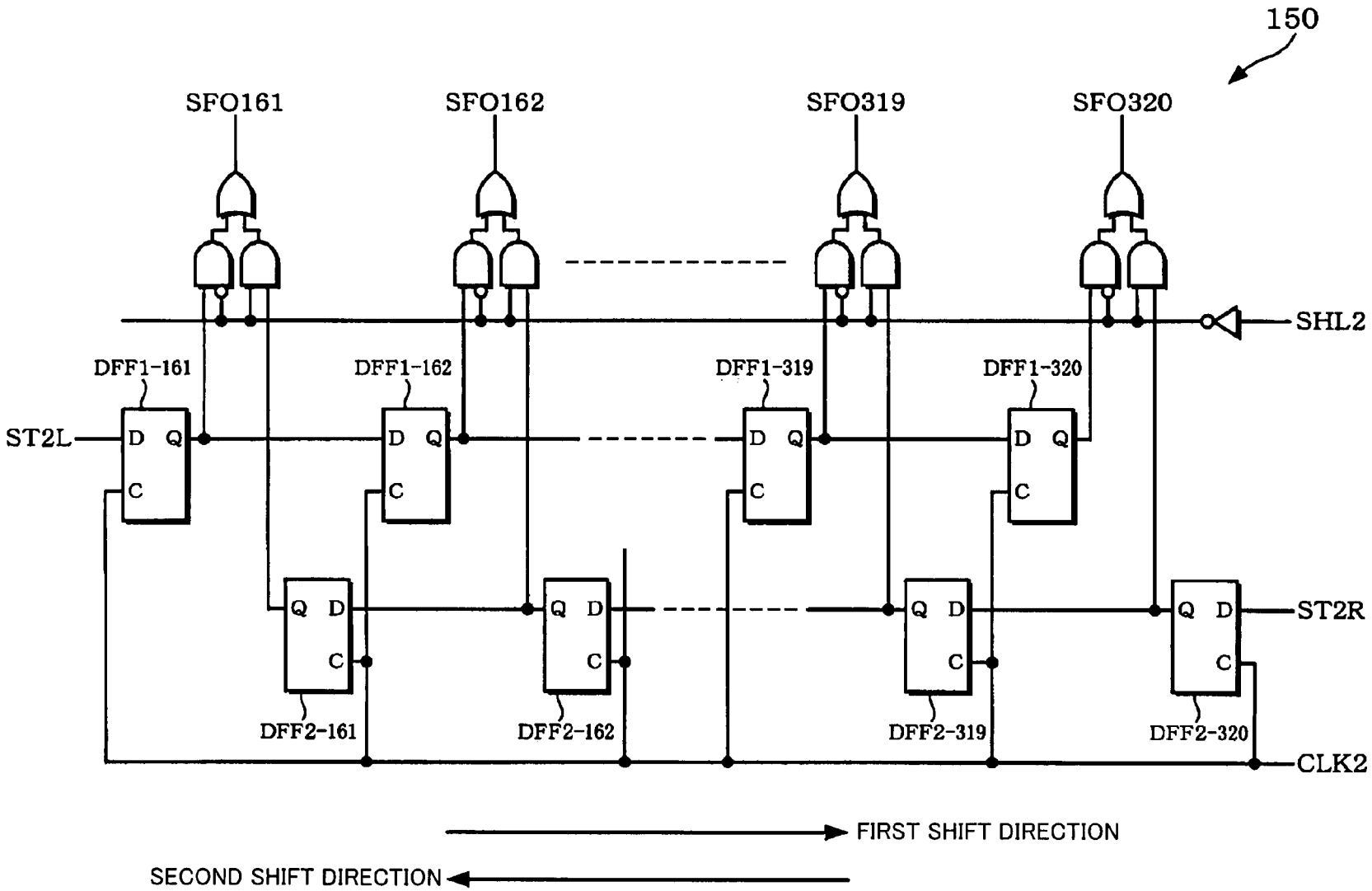
FIG. 10 is a circuit diagram showing a configuration example of a second bidirectional shift register.

FIG. 10 shows a configuration example of the second bidirectional shift register 150. In the second bidirectional shift register 150, D flip-flops DFF1-161 to DFF1-320 are connected in series so that a pulse of the second shift start signal ST2L is shifted in the first shift direction. A Q terminal of the D flip-flop DFF1-k (161≦k≦319, k is a natural number) is connected with a D terminal of the D flip-flop DFF 1-(k+1) in the subsequent stage. In the second bidirectional shift register 150, D flip-flops DFF2-320 to DFF2-161 are connected in series so that a pulse of the second shift start signal ST2R is shifted in the second shift direction. A Q terminal of the D flip-flop DFF2-k (162≦k≦320, k is a natural number) is connected with a D terminal of the D flip-flop DFF2-(k−1) in the subsequent stage.

Either the shift output from the Q terminal of the D flip-flop DFF1-i (161≦i≦320, i is a natural number) or the shift output from the Q terminal of the D flip-flop DFF2-i is selected by the second shift direction control signal SHL2 and output as the shift output SFOi.

The second shift start signal ST2L for outputting the shift output in the first shift direction is input to the D terminal of the D flip-flop DFF1-161. The second shift start signal ST2R for outputting the shift output in the second shift direction is input to the D terminal of the D flip-flop DFF2-320.

In FIG. 8, the first data latch 160 includes a plurality of flip-flops FF1 to FF160 (not shown) which correspond to the data output sections OUT1 to OUT160. The flip-flop FFi (1≦i≦160) holds the gray-scale data on the gray-scale bus 110 based on the shift output SFOi from the first bidirectional shift register 140. Specifically, the first data latch 160 latches the gray-scale data based on the shift output in each stage of the first bidirectional shift register 140. The gray-scale data held by the flip-flops of the first data latch 160 is output to the line latch 200 as the latch data LAT1 to LAT160.

The second data latch 170 includes a plurality of flip-flops FF161 to FF320 (not shown) which correspond to the data output sections OUT161 to OUT320. The flip-flop FFi (161≦i≦320) holds the gray-scale data on the gray-scale bus 110 based on the shift output SFOi from the second bidirectional shift register 150. Specifically, the second data latch 170 latches the gray-scale data based on the shift output in each stage of the second bidirectional shift register 150. The gray-scale data held by the flip-flops of the second data latch 170 is output to the line latch 200 as the latch data LAT161 to LAT320.

The data latch 100 includes a drive mode setting register 190. The drive mode setting register 190 is a register which can be set by the host or the like. The drive mode setting register 190 is a control register for setting either a normal drive mode or a comb-tooth drive mode. In the normal drive mode, the display driver 30 can drive the data lines of the LCD panel which is not comb-tooth distributed as shown in FIG. 3. In the comb-tooth drive mode, the display driver 30 can drive the data lines of the LCD panel which is comb-tooth distributed as shown in FIG. 1.

It is preferable that the shift directions of the first and second bidirectional shift registers 140 and 150 be controlled by the first and second shift direction control signals SHL1 and SHL2 according to the content of the drive mode setting register 190.

In more detail, it is preferable that the shift directions be controlled so that the first and second bidirectional shift registers 140 and 150 shift the signals in opposite directions by the first and second shift direction control signals SHL1 and SHL2 when the comb-tooth drive mode is set in the drive mode setting register 190. It is preferable that the shift directions be controlled so that the first and second bidirectional shift registers 140 and 150 shift the signals in the same direction by the first and second shift direction control signals SHL1 and SHL2 when the normal drive mode is set in the drive mode setting register 190.

As described above, the first and second data latches 160 and 170 can capture the gray-scale data on the gray-scale bus 110 connected in common with the first and second data latches 160 and 170 based on the shift outputs which can be generated separately. This enables the latch data corresponding to each data output section to be captured in the data latch 100 while changing the arrangement order of the gray-scale data on the gray-scale bus. Therefore, the comb-tooth distributed LCD panel 20 can be driven without using a data scramble IC by driving the data lines from the first side of the LCD panel 20 (electro-optical device) based on the data (LAT1 to LAT160) held in the flip-flops of the first data latch 160 and driving the data lines from the second side of the LCD panel 20 (electro-optical device) based on the data (LAT161 to LAT320) held in the flip-flops of the second data latch 170.

It is desirable that the display driver 30 includes a shift clock signal generation circuit as described below.

Figure 11:
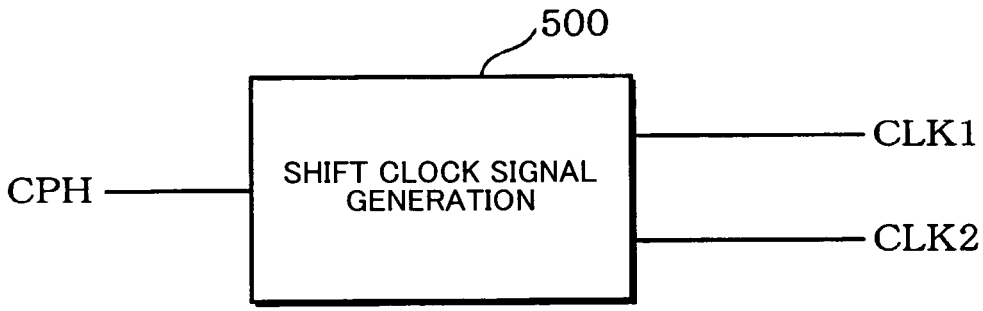
FIG. 11 is a configuration diagram of a shift clock signal generation circuit in an embodiment of the present invention.

FIG. 11 shows an outline of a configuration of a shift clock signal generation circuit. A shift clock signal generation circuit 500 generates the first and second shift clock signals CLK1 and CLK2 based on the reference clock signal CPH with which the gray-scale data is supplied in synchronization. The shift clock signal generation circuit 500 generates the first and second shift clock signals CLK1 and CLK2 so that the first and second shift clock signals CLK1 and CLK2 include a period in which the phases of the first and second shift clock signals CLK1 and CLK2 are reversed. This enables the first and second shift clock signals CLK1 and CLK2 for obtaining the shift outputs generated separately to be generated by using a simple configuration.

In the shift clock signal generation circuit 500, the first and second shift start signals ST1 and ST2 are allowed to be signals having the same phase by generating the first and second shift clock signals CLK1 and CLK2 as described below, whereby the configuration and control can be simplified.

Figure 12:
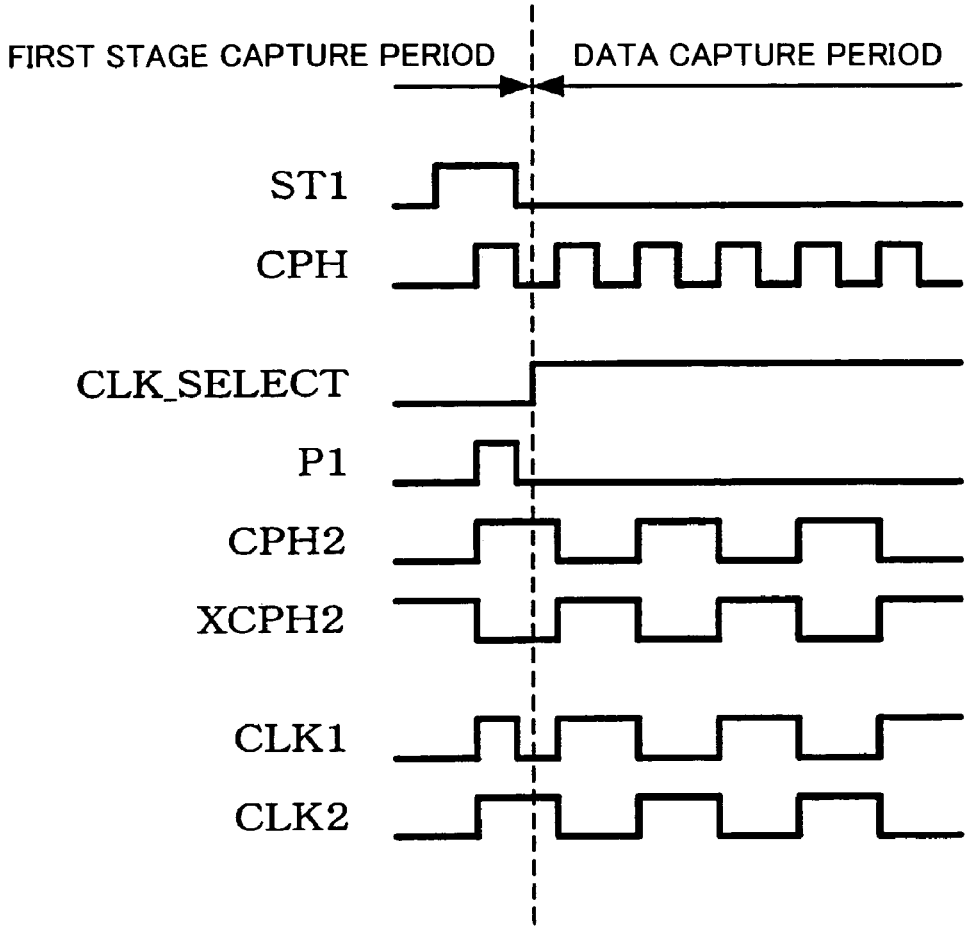
FIG. 12 is a timing chart showing an example of generation timing of first and second reference shift clock signals by a shift clock signal generation circuit.

FIG. 12 shows an example of generation timing of the first and second shift clock signals CLK1 and CLK2 by the shift clock signal generation circuit 500. In order to allow the first and second shift start signals ST1 and ST2 to be signals having the same phase, it is necessary to capture the first and second shift start signals ST1L (ST1R) and ST2R (ST2L) in the first stages of the first and second bidirectional shift registers 140 and 150, respectively.

The shift clock signal generation circuit 500 generates a clock signal select signal CLK_SELECT which specifies a first stage capture period and a data capture period (shift operation period). The first stage capture period may be referred to as a period in which the first shift start signal ST1L (ST1R) is captured in the first bidirectional shift register 140 or a period in which the second shift start signal ST2R (ST2L) is captured in the second bidirectional shift register 150. The data capture period may be referred to as a period in which the shift start signal captured in the first stage capture period is shifted after the first stage capture period has elapsed.

The first and second shift clock signals CLK1 and CLK2 are provided with edges for capturing the first and second shift start signals ST1L (ST1R) and ST2R (ST2L) by using the clock signal select signal CLK_SELECT.

Therefore, a pulse P1 of the reference clock signal CPH is generated in the first stage capture period. A frequency-divided clock signal CPH2 is generated by dividing the frequency of the reference clock signal CPH. The frequency-divided clock signal CPH2 is the second shift clock signal CLK2. An inverted frequency-divided clock signal XCPH2 is generated by reversing the phase of the frequency-divided clock signal CPH2.

The first shift clock signal CLK1 is generated by selectively outputting the pulse P1 of the reference clock signal CPH in the first stage capture period and selectively outputting the inverted frequency-divided clock signal XCPH2 in the data capture period by using the clock signal select signal CLK_SELECT.

Figure 13:
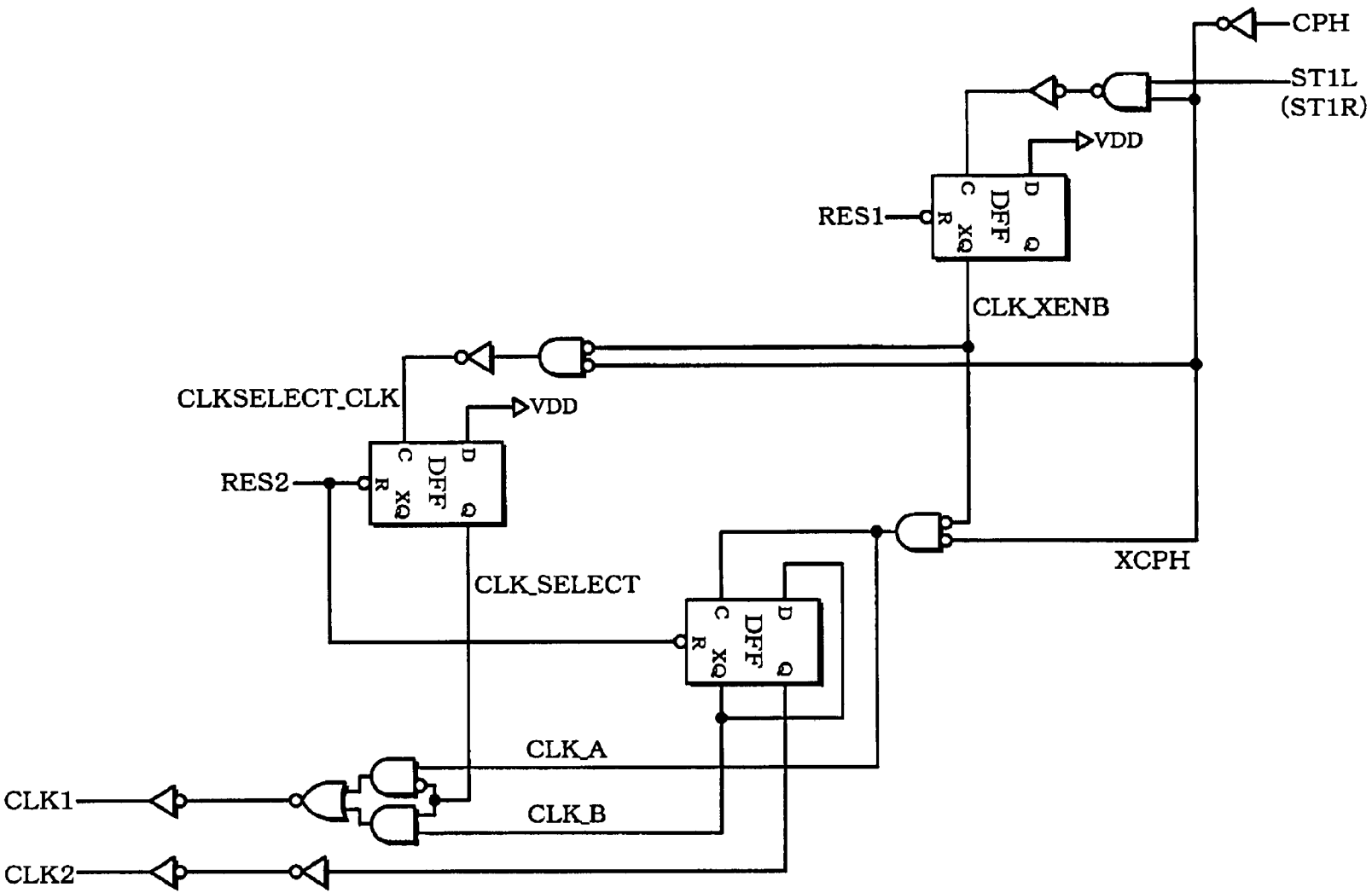
FIG. 13 is a circuit diagram showing a configuration example of a shift clock signal generation circuit.

FIG. 13 shows a circuit diagram which is a specific configuration example of the shift clock signal generation circuit 500.

Figure 14:
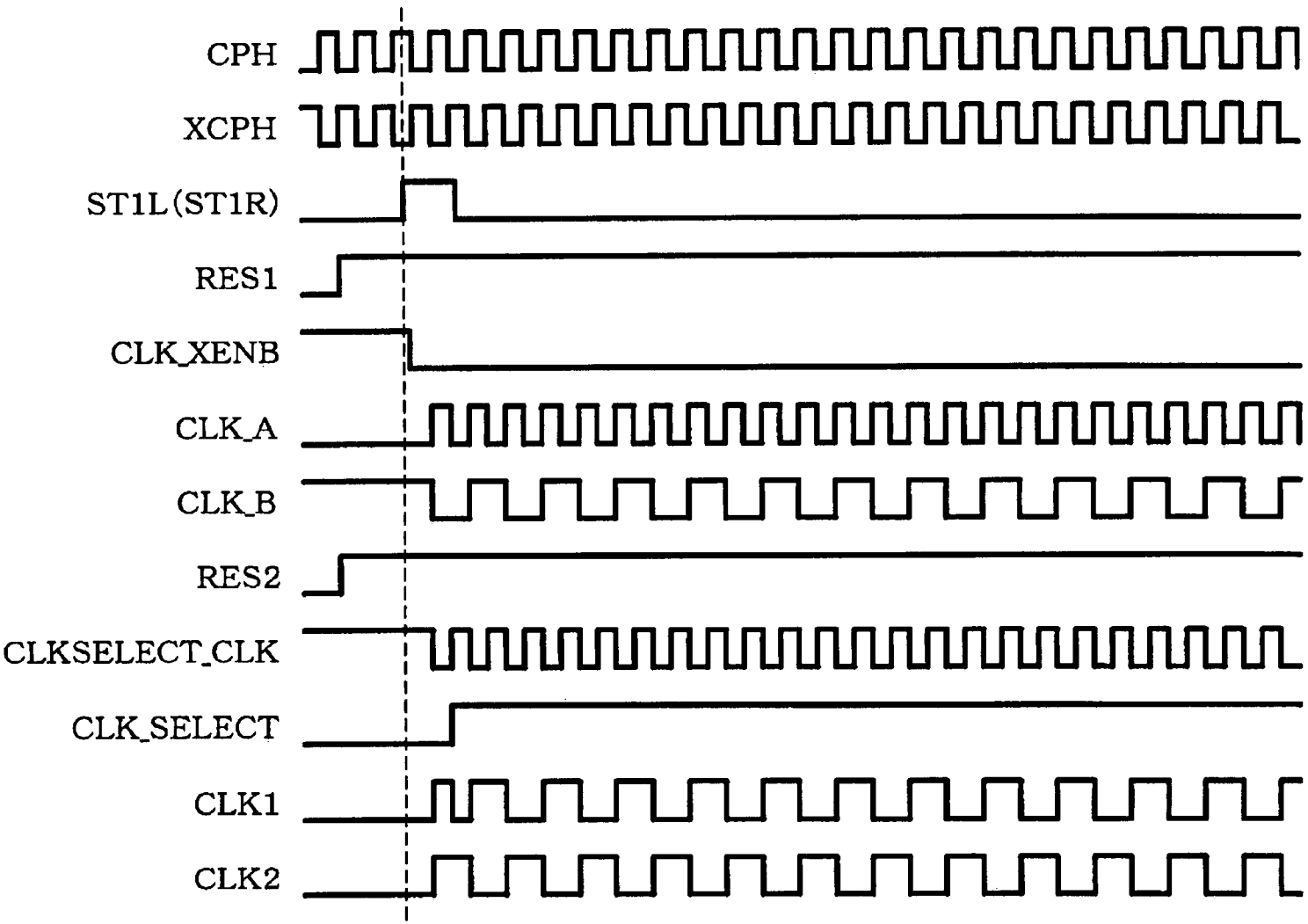
FIG. 14 is a timing chart of an operation example of the shift clock signal generation circuit shown in FIG. 13.

FIG. 14 shows an example of operation timing of the shift clock signal generation circuit 500 shown in FIG. 13.

In FIGS. 13 and 14, clock signals CLK_A and CLK_B are generated by using the reference clock signal CPH, and selectively output by using the clock signal select signal CLK_SELECT. The second shift clock signal CLK2 is a signal generated by reversing the clock signal CLK_B. The first shift clock signal CLK1 is a signal generated by selectively outputting the clock signal CLK_A in the first stage capture period in which the clock signal select signal CLK_SELECT is "L", and selectively outputting the clock signal CLK_B in the data capture period in which the clock signal select signal CLK_SELECT is "H".

The operation of the data latch 100 of the display driver 30 having the above-described configuration is described below.

Figure 15:
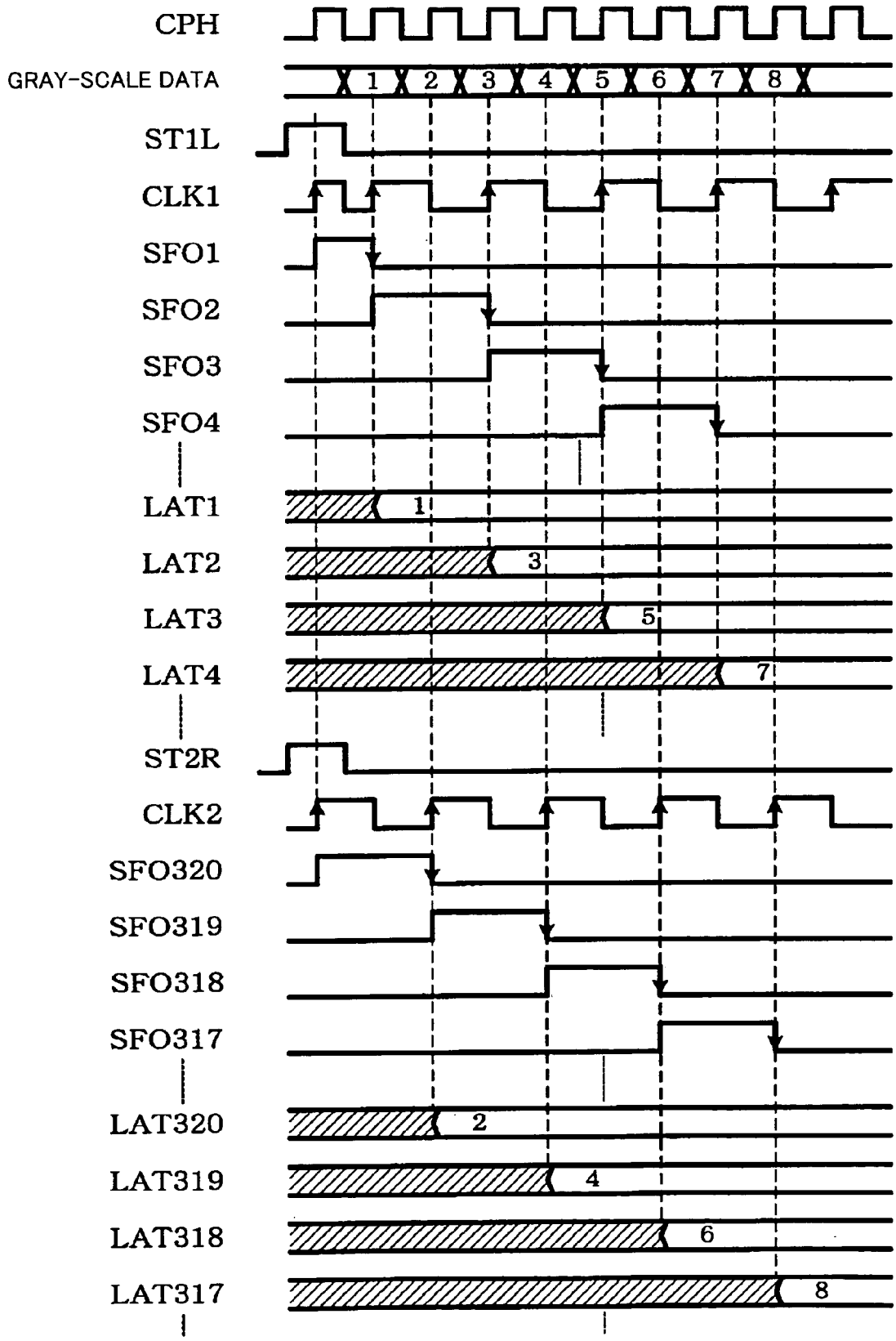
FIG. 15 is a timing chart showing an operation example of a data latch of a display driver in an embodiment of the present invention.

FIG. 15 shows an example of an operation timing chart of the data latch 100 of the display driver 30.

FIG. 15 shows a timing example in the case where the first and second shift direction control signals SHL1 and SHL2 are set at "H", and the first shift start signal ST1L and the second shift start signal ST2R are input. The first and second shift clock signals CLK1 and CLK2 are generated as shown in FIGS. 12 and 14, and the first and second shift start signals ST1 and ST2 are signals having the same phase.

The gray-scale data is supplied to the gray-scale bus 110 corresponding to the arrangement order of the data lines DL1 to DLN of the LCD panel 20. In this example, the gray-scale data corresponding to the data line DL1 is illustrated as DATA1 ("1" in FIG. 15), and the gray-scale data corresponding to the data line DL2 is illustrated as DATA2 ("2" in FIG. 15).

The first bidirectional shift register 140 shifts the first shift start signal ST1L in synchronization with the rising edge of the first shift clock signal CLK1. As a result, the first bidirectional shift register 140 outputs the shift outputs SFO1 to SFO160 in that order.

The second bidirectional shift register 150 shifts the second shift start signal ST2R in synchronization with the rising edge of the second shift clock signal CLK2 during the shift operation of the first bidirectional shift register 140. As a result, the second bidirectional shift register 150 outputs the shift outputs SFO320 to SFO161 in that order.

The first data latch 160 captures the gray-scale data on the gray-scale bus 110 at the falling edge of each shift output from the first bidirectional shift register 140. As a result, the first data latch 160 captures the gray-scale data DATA1 at the falling edge of the shift output SFO1, captures the gray-scale data DATA3 at the falling edge of the shift output SFO2, and captures the gray-scale data DATA5 at the falling edge of the shift output SFO3.

The second data latch 170 captures the gray-scale data on the gray-scale bus 110 at the falling edge of each shift output from the second bidirectional shift register 150. As a result, the second data latch 170 captures the gray-scale data DATA2 at the falling edge of the shift output SFO320, captures the gray-scale data DATA4 at the falling edge of the shift output SFO319, and captures the gray-scale data DATA6 at the falling edge of the shift output SFO318.

This enables the gray-scale data after data scrambling (see FIG. 5) corresponding to the data lines of the comb-tooth distributed LCD panel 20 to be captured. Therefore, the gray-scale data DATA1 to DATA320 is supplied to the corresponding data lines DL1 to DL320 of the LCD panel 20 shown in FIG. 1 or 4, whereby a correct image can be displayed.

Figure 16:
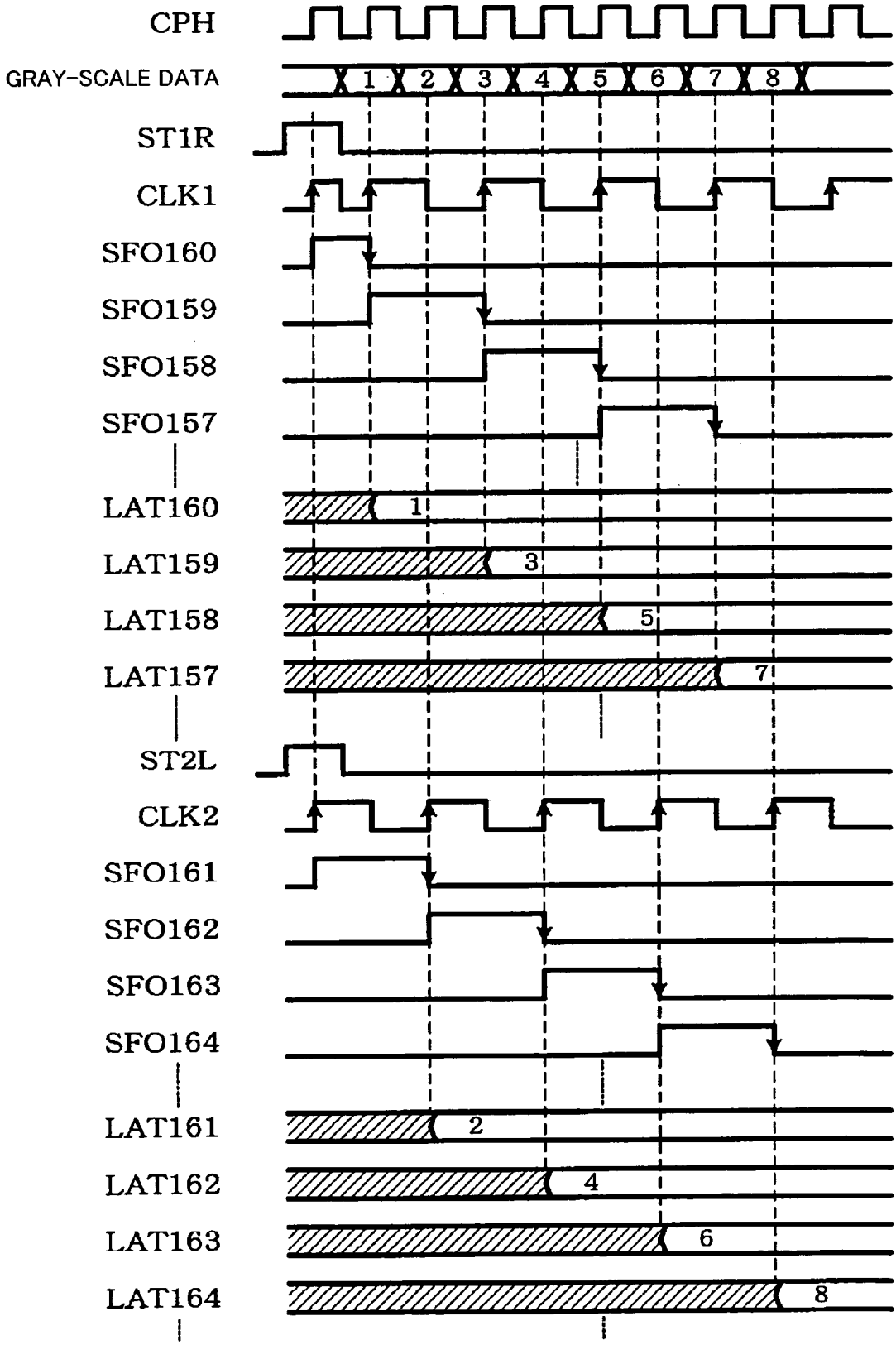
FIG. 16 is a timing chart showing another operation example of a data latch of a display driver in an embodiment of the present invention.

FIG. 16 shows another example of the operation timing chart of the data latch 100 of the display driver 30.

FIG. 16 shows a timing example in the case where the first and second shift direction control signals SHL1 and SHL2 are set at "L", and the first shift start signal ST1R and the second shift start signal ST2L are input. The first and second shift clock signals CLK1 and CLK2 are generated as shown in FIGS. 12 and 14, and the first and second shift start signals ST1 and ST2 are signals having the same phase.

The first bidirectional shift register 140 shifts the first shift start signal ST1R in synchronization with the rising edge of the first shift clock signal CLK1. As a result, the first bidirectional shift register 140 outputs the shift outputs SFO160 to SFO1 in that order.

The second bidirectional shift register 150 shifts the second shift start signal ST2L in synchronization with the rising edge of the second shift clock signal CLK2 during the shift operation of the first bidirectional shift register 140. As a result, the second bidirectional shift register 150 outputs the shift outputs SFO161 to SFO320 in that order.

The first data latch 160 captures the gray-scale data on the gray-scale bus 110 at the falling edge of each shift output from the first bidirectional shift register 0.140. As a result, the first data latch 160 captures the gray-scale data DATA1 at the falling edge of the shift output SFO160, captures the gray-scale data DATA3 at the falling edge of the shift output SFO159, and captures the gray-scale data DATA5 at the falling edge of the shift output SFO158.

The second data latch 170 captures the gray-scale data on the gray-scale bus 110 at the falling edge of each shift output from the second bidirectional shift register 150. As a result, the second data latch 170 captures the gray-scale data DATA2 at the falling edge of the shift output SFO161, captures the gray-scale data DATA4 at the falling edge of the shift output SFO162, and captures the gray-scale data DATA6 at the falling edge of the shift output SFO163.

This enables drive based on the gray-scale data DATA1 output from the data output section OUT160 and drive based on the gray-scale data DATA2 output from the data output section OUT161 to be performed as shown in FIG. 6B by changing the capture direction of the gray-scale data, whereby a correct image can be displayed even in the case shown in FIG. 6B.

3. Other Embodiments

In the case of driving the data lines of the comb-tooth distributed LCD panel 20 by using the display driver 30, it is preferable to change the arrangement order of the gray-scale data corresponding to the mounting state of the display driver 30.

Figure 17A:
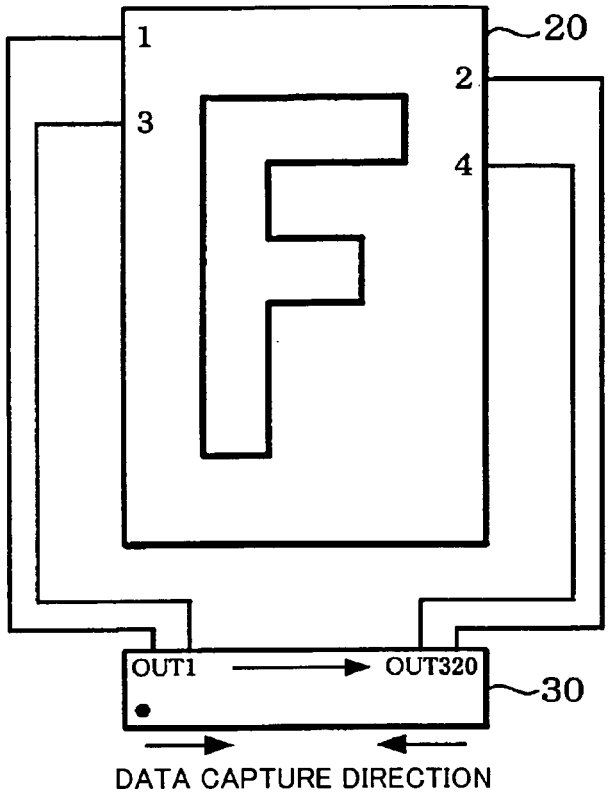
FIG. 17A is a schematic diagram showing a third mounting state of a display driver relative to an LCD panel.
Figure 17B:
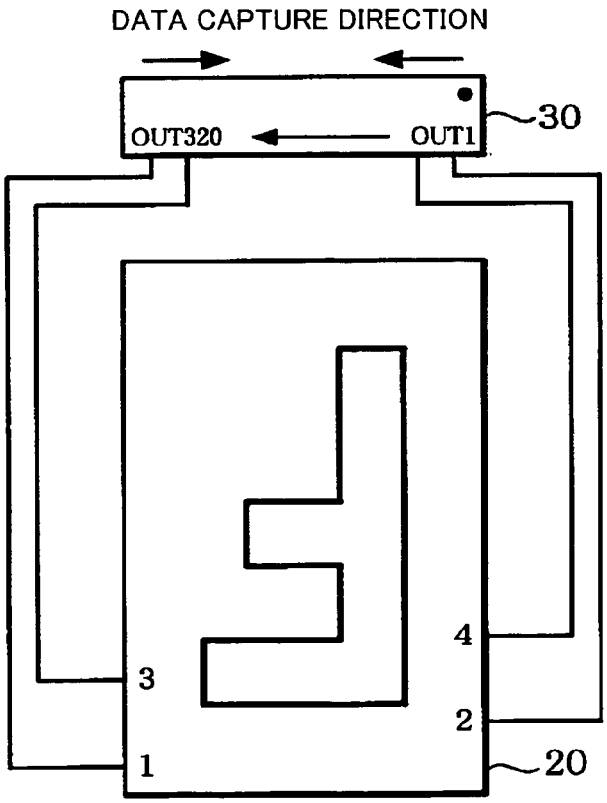
FIG. 17B is a schematic diagram showing a fourth mounting state of a display driver relative to an LCD panel.

FIG. 17A schematically shows a third mounting state of the display driver 30 relative to the LCD panel 20. FIG. 17B schematically shows a fourth mounting state of the display driver 30 relative to the LCD panel 20.

The following description is given on the assumption that the display driver 30 is capable of changing the arrangement order of the gray-scale data in order to display the image shown in FIG. 17A. Therefore, the display driver 30 captures the gray-scale data DATA1, DATA2, DATA3, . . . in the order of the data output section OUT1, the data output section OUT 320, and the data output section OUT 3, . . . as shown in FIG. 5 (a third mounting state).

However, if the display driver 30 captures the gray-scale data in the same order in the fourth mounting state, the drive voltage based on the gray-scale data DATA1 is output from the data output section OUT1. Therefore, the image shown in FIG. 17B cannot be displayed.

This problem also occurs depending on whether the display driver 30 is mounted on the LCD panel 20 in a state in which the front surface or the back surface of the chip of the display driver 30 faces the LCD panel 20.

In the display driver 30, it is preferable to change the arrangement order of the gray-scale data and the capture start order of the gray-scale data corresponding to the mounting state.

Therefore, a clock signal switch circuit may be provided to the data latch of the display driver 30.

Figure 18:
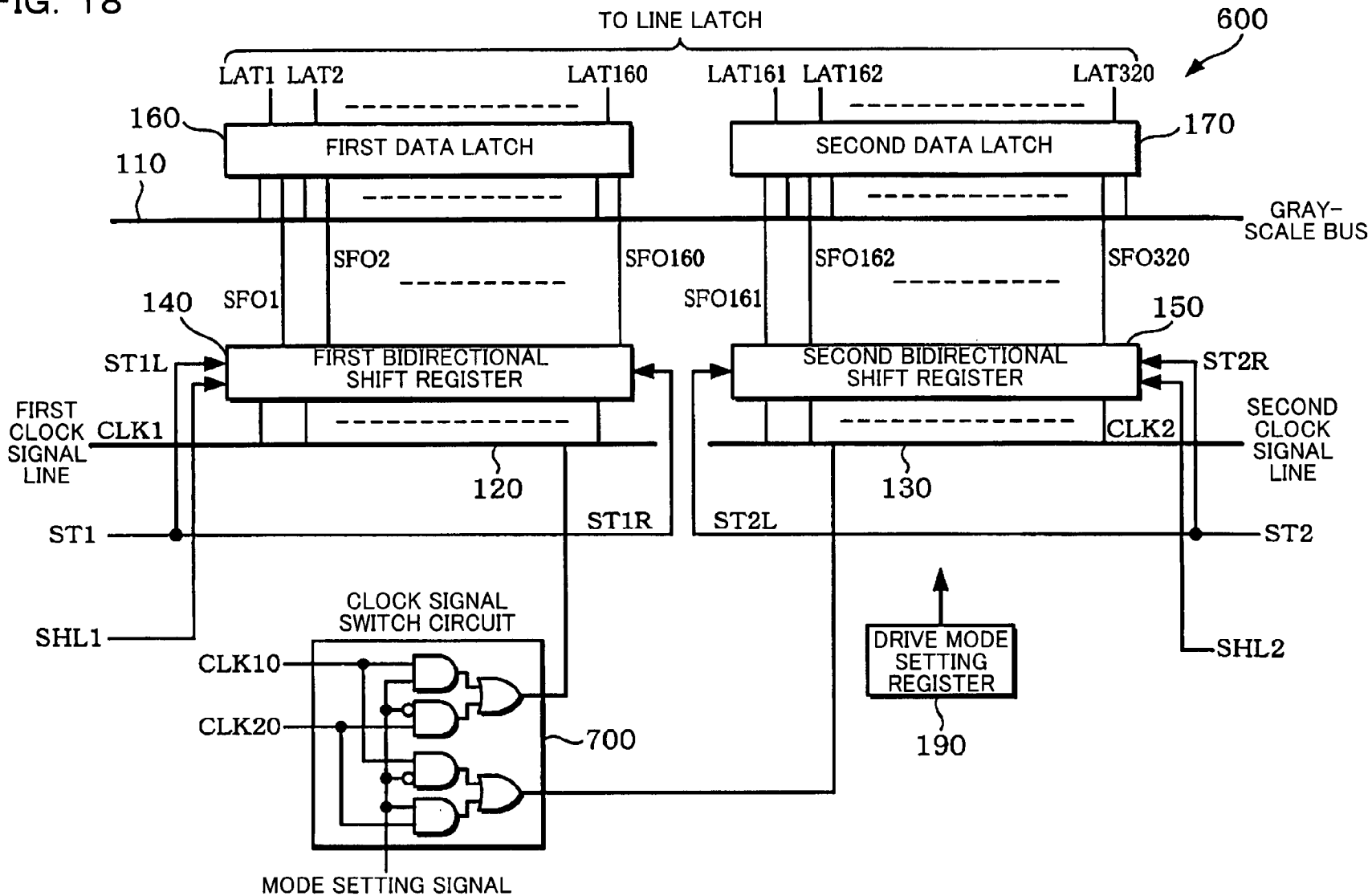
FIG. 18 is a block diagram of another configuration example of a data latch in an embodiment of the present invention.

FIG. 18 shows another configuration example of the data latch of the display driver 30. A data latch 600 shown in FIG. 18 differs from the data latch 100 shown in FIG. 8 in that the data latch 600 includes a clock signal switch circuit 700.

The clock signal switch circuit 700 outputs one of the first and second shift clock signals CLK1 and CLK2 to the first clock signal line 120 and outputs the other of the first and second shift clock signals CLK1 and CLK2 to the second clock signal line 130 based on a given mode setting signal. The mode setting signal is a signal which is set corresponding to the mounting state of the display driver 30. The mode setting signal is generated corresponding to the content of the drive mode setting register 190, for example.

In more detail, when the mode setting signal is set at "H" (first level), the clock signal switch circuit 700 outputs a first reference shift clock signal CLK10 to the first clock signal line 120 as the first shift clock signal CLK1, and outputs a second reference shift clock signal CLK20 to the second clock signal line 130 as the second shift clock signal CLK2. When the mode setting signal is set at "L" (second level), the clock signal switch circuit 700 outputs the second reference shift clock signal CLK20 to the first clock signal line 120 as the first shift clock signal CLK1, and outputs the first reference shift clock signal CLK10 to the second clock signal line 130 as the second shift clock signal CLK2.

The first and second reference shift clock signals CLK10 and CLK20 are generated by the shift clock signal generation circuit 500 shown in FIG. 11 based on the reference clock signal CPH instead of the first and second shift clock signals CLK and CLK2.

Since the shift clock signals output to the first and second clock signal lines 120 and 130 can each be replaced by the other using the mode setting signal, the capture start order of the gray-scale data by the first and second bidirectional shift registers 140 and 150 can be changed. Therefore, the capture start order of the gray-scale data can be changed corresponding to the mounting state of the display driver 30.

Figure 19:
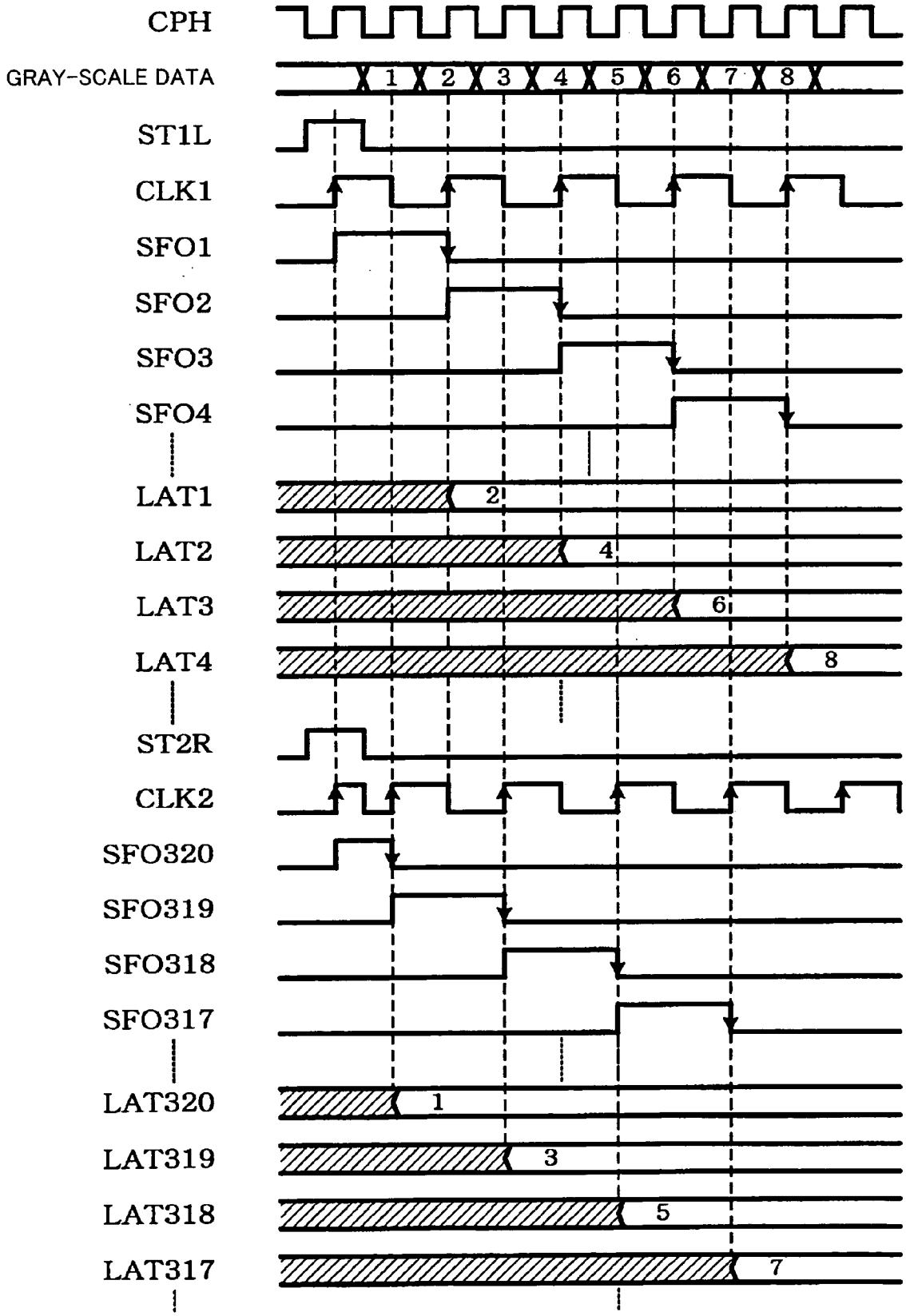
FIG. 19 is a timing chart showing an operation example of a data latch shown in FIG. 18.

FIG. 19 shows an example of an operation timing chart of the data latch 600.

FIG. 19 shows a timing example in the case where the first and second shift direction control signals SHL1 and SHL2 are set at "H", and the first shift start signal ST1L and the second shift start signal ST2R are input. FIG. 19 shows a timing example in the case where the mode setting signal is set at "L". Therefore, the first and second shift clock signals CLK1 and CLK2 are each replaced by the other in comparison with FIG. 15.

The first bidirectional shift register 140 shifts the first shift start signal ST1L in synchronization with the rising edge of the first shift clock signal CLK1. As a result, the first bidirectional shift register 140 outputs the shift outputs SFO1 to SFO160 in that order.

The second bidirectional shift register 150 shifts the second shift start signal ST2R in synchronization with the rising edge of the second shift clock signal CLK2 during the shift operation of the first bidirectional shift register 140. As a result, the second bidirectional shift register 150 outputs the shift outputs SFO320 to SFO161 in that order.

The first data latch 160 captures the gray-scale data on the gray-scale bus 110 at the falling edge of each shift output from the first bidirectional shift register 140. As a result, the first data latch 160 captures the gray-scale data DATA2 at the falling edge of the shift output SFO1, captures the gray-scale data DATA4 at the falling edge of the shift output SFO2, and captures the gray-scale data DATA6 at the falling edge of the shift output SFO3, and so on.

The second data latch 170 captures the gray-scale data on the gray-scale bus 110 at the falling edge of each shift output from the second bidirectional shift register 150. As a result, the second data latch 170 captures the gray-scale data DATA1 at the falling edge of the shift output SFO320, captures the gray-scale data DATA3 at the falling edge of the shift output SFO319, and captures the gray-scale data DATA5 at the falling edge of the shift output SFO318.

This enables drive based on the gray-scale data DATA1 from the data output section OUT320 and drive based on the gray-scale data DATA2 from the data output section OUT1 to be performed as shown in FIG. 17B by changing the capture start timing of the gray-scale data, whereby a correct image can be displayed even in the case shown in FIG. 17B.

The present invention is not limited to the above-described embodiment. Various modifications and variations are possible within the spirit and scope of the present invention. The above embodiment is described taking as an example an active matrix type liquid crystal panel in which each pixel of the display panel includes a TFT. However, the present invention is not limited thereto. The present invention can also be applied to a passive matrix type liquid crystal panel. The present invention can be applied to a plasma display device in addition to the liquid crystal panel, for example.

In the case of forming one pixel by using three dots, the present invention can be realized in the same manner as described above by replacing the data line with a set of three color component data lines.

Part of requirements of a claim of the present invention could be omitted from a dependent claim which depends on that claim. Moreover, part of requirements of any independent claim of the present invention could be made to depend on any other independent claim.

The specification discloses the following matters about the configuration of the embodiments described above.

According to one embodiment of the present invention, there is provided a display driver which drives a plurality of data lines of an electro-optical device, the electro-optical device including: a plurality of scan lines; the data lines which are alternately arranged inwardly from opposite sides of the electro-optical device to have a shape of comb-teeth; a plurality of switching elements, each of the switching elements being connected with one of the scan lines and one of the data lines; and a plurality of pixel electrodes, each of the pixel electrodes being connected with one of the switching elements, the display driver comprising:

a gray-scale bus to which gray-scale data is supplied corresponding to an arrangement order of the data lines;

a first bidirectional shift register which shifts a first shift start signal in a first shift direction specified by a first shift direction control signal, based on a first shift clock signal;

a second bidirectional shift register which shifts a second shift start signal in a second shift direction specified by a second shift direction control signal, based on a second shift clock signal;

a first data latch which includes a plurality of flip-flops, each of which holds the gray-scale data corresponding to one of the data lines, based on a shift output in each stage of the first bidirectional shift register;

a second data latch which includes a plurality of flip-flops, each of which holds the gray-scale data corresponding to one of the data lines, based on a shift output in each stage of the second bidirectional shift register; and a data line driver circuit in which a plurality of data output sections are disposed corresponding to the arrangement order of the data lines, each of the data output sections driving one of the data lines based on the gray-scale data held in the flip-flops of the first data latch or the flip-flops of the second data latch.

In this display driver, the gray-scale data supplied to the gray-scale bus corresponding to the arrangement order of the data lines of the electro-optical device can be captured in the first and second data latches by using the shift outputs based on the first and second shift clock signals which can be separately set. In the first and second bidirectional registers, the shift directions of the first and second shift start signals can be changed corresponding to the first and second shift direction control signals.

This enables the gray-scale data to be captured in the first and second data latches while changing the arrangement order of the gray-scale data on the gray-scale bus. Therefore, a comb-tooth distributed electro-optical device can be driven without using a data scramble IC as an additional circuit. Moreover, the capture direction of the gray-scale data can be changed by changing the shift directions of the first and second bidirectional shift registers. Therefore, the arrangement order of the gray-scale data and the capture direction of the gray-scale data can be changed corresponding to the orientation of an image to be displayed.

In the display driver, the data line driver circuit may drive the data lines from a first side of the electro-optical device, based on the data held in the flip-flops of the first data latch, and may drive the data lines from a second side of the electro-optical device, based on the data held in the flip-flops of the second data latch, the second side facing the first side.

In this configuration, the mounting size of the comb-tooth distributed electro-optical device can be reduced by driving the data lines from the first side based on the data held in the flip-flops of the first data latch, and driving the data lines from the second side of the electro-optical device which faces the first side based on the data held in the flip-flops of the second data latch.

The display driver may further comprise:

a drive mode setting register which sets the display driver into one of a normal drive mode and a comb-tooth drive mode, wherein the first and second shift directions may be determined so that the first and second bidirectional shift registers respectively shift the first and second shift start signals in opposite directions when the comb-tooth drive mode is set in the drive mode setting register, and wherein the first and second shift directions may be determined so that the first and second bidirectional shift registers respectively shift the first and second shift start signals in the same direction when the normal drive mode is set in the drive mode setting register.

In this configuration, a display driver which can display a correct image corresponding to the orientation of the image to be displayed, even in the case where the data lines are comb-tooth distributed or the data lines are not comb-tooth distributed, can be provided.

The display driver may further comprise:

a shift clock signal generation circuit which generates the first and second shift clock signals based on a given reference clock signal, wherein a shift operation period of the first and second bidirectional shift registers may include a period in which phases of the first and second shift clock signals are reversed.

In the display driver, the first and second shift start signals may have the same phase, and the shift clock signal generation circuit may generate the second shift clock signal by dividing frequency of the given reference clock signal, and may generate the first shift clock signal which has a given pulse in a first stage capture period for capturing the first shift start signal in the first bidirectional shift register and has a phase which is the reverse of the phase of the second shift clock signal in a data capture period after the first stage capture period has elapsed.

In this configuration, generation of the first and second shift clock signals can be further simplified, and the first and second shift start signals are allowed to be signals having the same phase. Therefore, the configuration and control of the display driver can be simplified.

In the display driver, a direction from the first side to the second side in which the data lines extend may be the same as one of the first and second shift direction.

In the display driver, in a case where the scan lines extend in a direction along a long side of the electro-optical device and the data lines extend in a direction along a short side of the electro-optical device, the display driver may be disposed along the short side.

In this configuration, the mounting size of the comb-tooth distributed electro-optical device can be reduced as the number of data lines increases.

According to another embodiment of the present invention, there is provided an electro-optical device comprising:

a plurality of scan lines;

a plurality of data lines, a given number of the data lines being alternately arranged inwardly from opposite sides of the electro-optical device to have a shape of comb-teeth;

a plurality of switching elements, each of the switching elements being connected with one of the scan lines and one of the data lines;

a plurality of pixel electrodes, each of the pixel electrodes being connected with one of the switching elements;

one of the above described display drivers which drives the data lines; and a scan driver which scans the scan lines.

According to a further embodiment of the present invention, there is provided an electro-optical device comprising:

a display panel having a first side and a second side which faces the first side, the display panel including: a plurality of scan lines; a plurality of data lines, a given number of the data lines being alternately arranged inwardly from the first and second sides to have a shape of comb-teeth; a plurality of switching elements, each of the switching elements being connected with one of the scan lines and one of the data lines; a plurality of pixel electrodes, each of the pixel electrodes being connected with one of the switching elements;

one of the above described display driver which drives the data lines; and a scan driver which scans the scan lines.

According to the above electro-optical devices, an electro-optical device which can be readily mounted on electronic instruments can be provided by reducing the mounting size.

What is claimed is:

1. A display driver which drives a plurality of data lines of an electro-optical device, the electro-optical device including: a plurality of scan lines; the data lines which are alternately arranged inwardly from opposite sides of the electro-optical device to have a shape of comb-teeth; a plurality of switching elements, each of the switching elements being connected with one of the scan lines and one of the data lines; and a plurality of pixel electrodes, each of the pixel electrodes being connected with one of the switching elements, the display driver comprising:

a gray-scale bus to which gray-scale data is supplied corresponding to an arrangement order of the data lines;

a first bidirectional shift register which shifts a first shift start signal in a first shift direction specified by a first shift direction control signal, based on a first shift clock signal;

a second bidirectional shift register which shifts a second shift start signal in a second shift direction specified by a second shift direction control signal, based on a second shift clock signal;

a first data latch which includes a plurality of flip-flops, each of which holds the gray-scale data corresponding to one of the data lines, based on a shift output in each stage of the first bidirectional shift register;

a second data latch which includes a plurality of flip-flops, each of which holds the gray-scale data corresponding to one of the data lines, based on a shift output in each stage of the second bidirectional shift register; and a data line driver circuit in which a plurality of data output sections are disposed corresponding to the arrangement order of the data lines, each of the data output sections driving one of the data lines based on the gray-scale data held in the flip-flops of the first data latch or the flip-flops of the second data latch.

2. The display driver as defined in claim 1, wherein the data line driver circuit drives the data lines from a first side of the electro-optical device, based on the data held in the flip-flops of the first data latch, and drives the data lines from a second side of the electro-optical device, based on the data held in the flip-flops of the second data latch, the second side facing the first side.

3. The display driver as defined in claim 2, wherein a direction from the first side to the second side in which the data lines extend is the same as one of the first and second shift direction.

4. The display driver as defined in claim 2, further comprising:

a shift clock signal generation circuit which generates the first and second shift clock signals based on a given reference clock signal, wherein a shift operation period of the first and second bidirectional shift registers includes a period in which phases of the first and second shift clock signals are reversed.

5. The display driver as defined in claim 4, wherein the first and second shift start signals have the same phase, and wherein the shift clock signal generation circuit generates the second shift clock signal by dividing frequency of the given reference clock signal, and generates the first shift clock signal which has a given pulse in a first stage capture period for capturing the first shift start signal in the first bidirectional shift register and has a phase which is the reverse of the phase of the second shift clock signal in a data capture period after the first stage capture period has elapsed.

6. The display driver as defined in claim 2, further comprising:

a drive mode setting register which sets the display driver into one of a normal drive mode and a comb-tooth drive mode, wherein the first and second shift directions are determined so that the first and second bidirectional shift registers respectively shift the first and second shift start signals in opposite directions when the comb-tooth drive mode is set in the drive mode setting register, and wherein the first and second shift directions are determined so that the first and second bidirectional shift registers respectively shift the first and second shift start signals in the same direction when the normal drive mode is set in the drive mode setting register.

7. The display driver as defined in claim 6, further comprising:

a shift clock signal generation circuit which generates the first and second shift clock signals based on a given reference clock signal, wherein a shift operation period of the first and second bidirectional shift registers includes a period in which phases of the first and second shift clock signals are reversed.

8. The display driver as defined in claim 7, wherein the first and second shift start signals have the same phase, and wherein the shift clock signal generation circuit generates the second shift clock signal by dividing frequency of the given reference clock signal, and generates the first shift clock signal which has a given pulse in a first stage capture period for capturing the first shift start signal in the first bidirectional shift register and has a phase which is the reverse of the phase of the second shift clock signal in a data capture period after the first stage capture period has elapsed.

9. The display driver as defined in claim 6, wherein a direction from a first side of the electro-optical device to a second side of the electro-optical device in which the data lines extend is the same as one of the first and second shift direction, the second side facing the first side.

10. The display driver as defined in claim 1, further comprising:

a drive mode setting register which sets the display driver into one of a normal drive mode and a comb-tooth drive mode, wherein the first and second shift directions are determined so that the first and second bidirectional shift registers respectively shift the first and second shift start signals in opposite directions when the comb-tooth drive mode is set in the drive mode setting register, and wherein the first and second shift directions are determined so that the first and second bidirectional shift registers respectively shift the first and second shift start signals in the same direction when the normal drive mode is set in the drive mode setting register.

11. The display driver as defined in claim 10, further comprising:

a shift clock signal generation circuit which generates the first and second shift clock signals based on a given reference clock signal, wherein a shift operation period of the first and second bidirectional shift registers includes a period in which phases of the first and second shift clock signals are reversed.

12. The display driver as defined in claim 11, wherein the first and second shift start signals have the same phase, and wherein the shift clock signal generation circuit generates the second shift clock signal by dividing frequency of the given reference clock signal, and generates the first shift clock signal which has a given pulse in a first stage capture period for capturing the first shift start signal in the first bidirectional shift register and has a phase which is the reverse of the phase of the second shift clock signal in a data capture period after the first stage capture period has elapsed.

13. The display driver as defined in claim 10, wherein a direction from a first side of the electro-optical device to a second side of the electro-optical device in which the data lines extend is the same as one of the first and second shift direction, the second side facing the first side.

14. The display driver as defined in claim 1, further comprising:

a shift clock signal generation circuit which generates the first and second shift clock signals based on a given reference clock signal, wherein a shift operation period of the first and second bidirectional shift registers includes a period in which phases of the first and second shift clock signals are reversed.

15. The display driver as defined in claim 14, wherein the first and second shift start signals have the same phase, and wherein the shift clock signal generation circuit generates the second shift clock signal by dividing frequency of the given reference clock signal, and generates the first shift clock signal which has a given pulse in a first stage capture period for capturing the first shift start signal in the first bidirectional shift register and has a phase which is the reverse of the phase of the second shift clock signal in a data capture period after the first stage capture period has elapsed.

16. The display driver as defined in claim 15, wherein a direction from a first side of the electro-optical device to a second side of the electro-optical device in which the data lines extend is the same as one of the first and second shift direction, the second side facing the first side.

17. The display driver as defined in claim 14, wherein a direction from a first side of the electro-optical device to a second side of the electro-optical device in which the data lines extend is the same as one of the first and second shift direction, the second side facing the first side.

18. The display driver as defined in claim 1, wherein a direction from a first side of the electro-optical device to a second side of the electro-optical device in which the data lines extend is the same as one of the first and second shift direction, the second side facing the first side.

19. The display driver as defined in claim 1, wherein, in a case where the scan lines extend in a direction along a long side of the electro-optical device and the data lines extend in a direction along a short side of the electro-optical device, the display driver is disposed along the short side.

20. An electro-optical device comprising:

a plurality of scan lines;

a plurality of data lines, a given number of the data lines being alternately arranged inwardly from opposite sides of the electro-optical device to have a shape of comb-teeth;

a plurality of switching elements, each of the switching elements being connected with one of the scan lines and one of the data lines;

a plurality of pixel electrodes, each of the pixel electrodes being connected with one of the switching elements;

the display driver as defined in claim 1 which drives the data lines; and a scan driver which scans the scan lines.

21. An electro-optical device comprising:

a display panel having a first side and a second side which faces the first side, the display panel including: a plurality of scan lines; a plurality of data lines, a given number of the data lines being alternately arranged inwardly from the first and second sides to have a shape of comb-teeth; a plurality of switching elements, each of the switching elements being connected with one of the scan lines and one of the data lines; a plurality of pixel electrodes, each of the pixel electrodes being connected with one of the switching elements;

the display driver as defined in claim 1 which drives the data lines; and a scan driver which scans the scan lines.

* * * * *